US009064367B2

(12) United States Patent
Tomizawa et al.

(10) Patent No.: US 9,064,367 B2
(45) Date of Patent: Jun. 23, 2015

(54) BANKNOTE DEPOSIT AND WITHDRAWAL DEVICE AND BANKNOTE DEPOSIT AND WITHDRAWAL CONTROL METHOD

(75) Inventors: Katsuyoshi Tomizawa, Gunma (JP); Yukihiro Nemoto, Gunma (JP); Katsuhiko Koseki, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 62 days.

(21) Appl. No.: 13/564,998

(22) Filed: Aug. 2, 2012

(65) Prior Publication Data

US 2013/0046407 A1 Feb. 21, 2013

(30) Foreign Application Priority Data

Aug. 16, 2011 (JP) ..... 2011-177973

(51) Int. Cl.
*G07F 19/00* (2006.01)
*G07D 7/00* (2006.01)

(52) U.S. Cl.
CPC ..... *G07F 19/202* (2013.01); *G07F 19/203* (2013.01); *G07D 7/0033* (2013.01)

(58) Field of Classification Search
CPC ..... G07D 11/0081; G07D 11/0084; G07F 19/203; G07F 19/204
USPC ..... 235/379
See application file for complete search history.

(56) References Cited

U.S. PATENT DOCUMENTS 6,771,180 B2 * 8/2004 Mizuta et al. ..... 340/674
8,579,278 B2 * 11/2013 Arikata et al. ..... 271/162
8,684,154 B2 * 4/2014 Mizushima et al. ..... 194/206
2005/0150740 A1 * 7/2005 Finkenzeller et al. ..... 194/207
2009/0229947 A1 * 9/2009 Takai et al. ..... 194/206
2010/0245043 A1 9/2010 Doi et al.

FOREIGN PATENT DOCUMENTS

CN 102013128 A 4/2011
JP 07-109054 A 4/1995
JP 07-121753 A 5/1995
JP 2002-074464 A 3/2002

(Continued)

OTHER PUBLICATIONS

Chinese Office Action issued on Mar. 13, 2014 with English translation.

(Continued)

*Primary Examiner* — Thien M Le
*Assistant Examiner* — Toan Ly
(74) *Attorney, Agent, or Firm* — Rabin & Berdo, P.C.

(57) ABSTRACT

The present invention provides a banknote deposit and withdrawal device including: a verification section that verifies banknotes inserted through a service aperture for performing a transaction of banknotes; a serial number acquisition section that acquires serial numbers of the banknotes; a control section that controls conveyance of the banknotes in the device; and a memory section that, for each of one or plural storage cassettes in which the banknotes are stored in the device, memorizes the serial numbers of banknotes stored in the storage cassette and memorizes a storage sequence of the banknotes as administration information, wherein the control section conveys a banknote to a corresponding storage cassette, on the basis of a result of verification, and records the serial number of the banknote and the storage sequence of the banknote in the storage cassette in the memory section as administration information.

12 Claims, 27 Drawing Sheets

(56) References Cited

FOREIGN PATENT DOCUMENTS

| | | | |
|---|---|---|---|
| JP | 2003-085617 | A | 3/2003 |
| JP | 2005-275876 | A | 10/2005 |
| JP | 2010-191881 | A | 9/2010 |
| JP | 2010-231784 | A | 10/2010 |

OTHER PUBLICATIONS

Japanese Office Action issued on Nov. 25, 2014, with English translation.
Japanese Office Action issued on Apr. 7, 2015 with an English translation.

* cited by examiner

FIG.2

| | STORAGE CASSETTE A | STORAGE CASSETTE B | STORAGE CASSETTE C | STORAGE CASSETTE D |
|---|---|---|---|---|
| SERIAL NO. 1 | A0001234 | A0003456 | (NO STACK) | A0005678 |
| SERIAL NO. 2 | A0002345 | A0004567 | | A0006789 |
| ⋮ | ⋮ | ⋮ | | ⋮ |
| SERIAL NO. N | A0007890 | A0008901 | | A0009900 |

BANKNOTE DEPOSIT AND WITHDRAWAL DEVICE AND BANKNOTE DEPOSIT AND WITHDRAWAL CONTROL METHOD

CROSS-REFERENCE TO RELATED APPLICATION

This application claims priority under 35 USC 119 from Japanese Patent Application No. 2011-177973, filed on Aug. 16, 2011, the disclosure of which is incorporated by reference herein.

BACKGROUND OF THE INVENTION

1. Field of the Invention

The present invention relates to a banknote deposit and withdrawal device and a banknote deposit and withdrawal control method. More specifically, the present invention relates to a banknote deposit and withdrawal device and banknote deposit and withdrawal control method that may differentially administer banknotes inserted by a customer and banknotes retained by the device.

2. Description of the Related Art

Banknote deposit and withdrawal devices that are used in banking activities and the like generally retain banknotes in a temporary retention section before storing the banknotes, and store the banknotes from the temporary retention section into a storage cassette only after a transaction is confirmed. In a banknote deposit and withdrawal device, that is equipped with a temporary retention section, banknotes of unconfirmed transactions and banknotes already stored in the device may be easily differentiated. However, in order to simplify the configurations of the devices, banknote deposit and withdrawal devices that do not have a temporary retention section are being used. Techniques have been proposed for differentiating between banknotes inserted by customers and banknotes retained, by the devices in banknote deposit and withdrawal devices, that do not have temporary retention sections.

For example, in Japanese Patent Application Laid-Open (JP-A) No. 2002-74464, a technique is disclosed in which, when a fault such as a jam or the like occurs during a deposit, all banknotes in a stacking section are extracted, the banknotes are re-verified one by one and counted, and thus the banknotes of the deposit are identified.

However, with the technique recited in JP-A No. 2002-74464, depending on the severity of the fault in the banknote deposit and withdrawal device, it may not be possible to identify a number of banknotes in a situation in which the banknotes cannot be re-verified. Moreover, because all banknotes remaining in the stacking section are re-verified, it takes time to identify the banknotes inserted by the customer.

SUMMARY OF THE INVENTION

The present invention provides banknote deposit and withdrawal device and banknote deposit and withdrawal control method that may reliably differentiate between the banknotes inserted by a customer and the banknotes from within the device, even when a fault occurs during a deposit transaction.

A first aspect of the present invention is a banknote deposit and withdrawal device including: a verification section that verifies banknotes inserted through a service aperture for performing a transaction of banknotes with a user; a serial number acquisition section that acquires serial numbers of the banknotes; a control section that controls conveyance of the banknotes in the device; and a memory section that, for each of one or more storage cassette in which the banknotes are stored in the device, memorizes the serial numbers of banknotes stored in the storage cassette and memorizes a storage sequence of the banknotes as administration information, wherein the control section conveys a banknote to a corresponding storage cassette on the basis of a result of verification, and records the serial number of the banknote and the storage sequence of the banknote in the storage cassette in the memory section as administration information.

According to the first aspect of the present invention, when banknotes inserted through the service aperture are stored in the storage cassettes in accordance with the verification results from the verification section, the control section records serial numbers and storage sequences of the banknotes as administration information in the memory section, for each storage cassette that is a storage destination of the banknotes. Thus, the first aspect of the present invention administers serial numbers and storage sequences in the storage cassettes of the banknotes held in the device. Therefore, in a case in which a process for returning the banknotes is performed or the device has a fault and stops during a transaction and subsequently restarts, or the like, the device may reliably ascertain conveyance destinations and storage destinations of respective banknotes by acquiring the serial numbers of the banknotes.

In a second aspect of the present invention, in the above aspect, the memory section may confirm an update of the administration information when the transaction of banknotes with the user is confirmed.

Thus, the second aspect of the present invention may differentially administer currently deposited banknotes and banknotes already in the device, until the transaction of the banknotes with the user is confirmed.

In a third aspect of the present invention, in the above aspects, the control section may detect, with the verification section, whether there is a defect in conveyance of the banknotes, in a case in which banknotes of a current transaction that have been stored in the storage cassette are conveyed to the service aperture in accordance with a request for return of the banknotes of the current transaction, and the control section may acquire, one at a time, the serial numbers of the banknotes conveyed from the storage cassette to the service aperture and, in accordance with the administration information, conveys only the banknotes of the current transaction to the service aperture, in a case in which a defect in conveyance of the banknotes is detected by the verification section.

In a fourth aspect of the present invention, in the above first and second aspects, the control section may detect, with the verification section, whether there is a defect in conveyance of the banknotes, in a case in which banknotes of a current transaction that have been stored in the storage cassette are conveyed to the service aperture in accordance with a request for return of the banknotes of the current transaction, the control section may temporarily store in the storage cassette, out of the banknotes conveyed from the storage cassette to the service aperture, the banknotes of the current transaction other than a banknote that was stored in the storage cassette first, in a case in which a defect in conveyance of the banknotes is detected by the verification section, the control section may acquire, one at a time, the serial numbers of banknotes remaining in the storage cassette and, in accordance with the administration information, alters a storage sequence of the banknotes remaining in the storage cassette such that a banknote other than the banknotes of the current transaction is disposed at a banknote feed-out aperture side of the service aperture, and the control section may convey the banknotes of the current transaction that have been temporarily stored in the storage cassette back to the service aperture, and then may convey the banknote other than the banknotes of the current transaction that is disposed at the feed-out aperture side of the service aperture to the storage cassette.

In a fifth aspect of the present invention, in the above aspects, may further include a reporting section that reports information to a user, wherein, when a defect occurs in the banknote deposit and withdrawal device, the control section may convey only the banknotes of a current transaction to the service aperture, in a case in which re-verification of banknotes is possible after the defect occurrence, and the control section may report serial numbers and storage sequences of the banknotes of the current transaction to a user via the reporting section, in a case in which re-verification of the banknotes after the defect occurrence is not possible.

In a sixth aspect of the present invention, in the above aspects, the banknote deposit and withdrawal device may include: a service unit including the service aperture, a conveyance path that connects the service aperture with storage destinations of the banknotes, a switching mechanism that switches a path of travel of the banknotes in accordance with the storage destination of a banknote being conveyed along the conveyance path, and the verification section that verifies the banknote being conveyed along the conveyance path; one or more storage cassette, each including a storage section that stores banknotes, a first conveyance path that connects with the service unit and other adjacent unit, a second conveyance path that conveys banknotes two ways between the first conveyance path and the storage section, a switching mechanism that switches the path of travel of the banknotes, and a thickness sensor that identifies thicknesses of banknotes being fed out from the storage section; and a reject holding unit that stores banknotes that are not retained in the service unit or the storage cassette.

In a seventh aspect of the present invention, in the above first to fifth aspects, the banknote deposit and withdrawal device may include: a service unit including the service aperture, a conveyance path that connects the service aperture with storage destinations of the banknotes, a switching mechanism that switches a path of travel of the banknotes in accordance with the storage destination of a banknote being conveyed along the conveyance path, the verification section that verifies the banknote being conveyed along the conveyance path, and a thickness sensor that identifies thicknesses of banknotes being fed out to the service aperture; one or more storage cassette, each including a storage section that stores banknotes, a first conveyance path that connects with the service unit and other adjacent unit, a second conveyance path that conveys banknotes two ways between the first conveyance path and the storage section, and a switching mechanism that switches the path of travel of the banknotes; and a reject holding unit that stores banknotes that are not retained in the service unit or the storage cassette.

In an eighth aspect of the present invention, in the above first to fifth aspects, the banknote deposit and withdrawal device may include: a service unit including the service aperture, a conveyance path that connects the service aperture with storage destinations of the banknotes, a switching mechanism that switches a path of travel of the banknotes in accordance with the storage destination of a banknote being conveyed along the conveyance path, and the verification section that verifies the banknote being conveyed along the conveyance path; one or more storage cassette, each including a storage section that stores banknotes, and a conveyance path that conveys the banknotes two ways to and from the storage section; a conveyance unit including a conveyance path that connects between the service unit and each storage cassette, one or more switching mechanism that switches the path of travel of the banknotes in accordance with the storage destination of the banknote being conveyed along the conveyance path, and a thickness sensor that identifies thicknesses of banknotes fed out from each storage cassette; and a reject holding unit that stores banknotes that are not retained in the service unit or the storage cassette.

In a ninth aspect of the present invention, in the above first to fifth aspects, the banknote deposit and withdrawal device may include: a service unit including the service aperture, and a conveyance path that connects an adjacent unit with the service aperture; a verification and conveyance unit including a conveyance path that connects the service unit with storage destinations of the banknotes, a switching mechanism that switches a path of travel of the banknotes in accordance with the storage destination of a banknote being conveyed along the conveyance path, and the verification section that verifies the banknotes being conveyed along the conveyance path; one or more storage cassette, each including a storage section that stores banknotes, and a conveyance path that conveys the banknotes two ways to and from the storage section; a conveyance unit including a conveyance path that connects between the verification and conveyance unit and each storage cassette, one or more switching mechanism that switches the path of travel of the banknotes in accordance with the storage destination of the banknote being conveyed along the conveyance path, and a thickness sensor that identifies thicknesses of banknotes fed out from each storage cassette; and a reject holding unit that stores banknotes that are not retained in the service unit or the storage cassette.

A tenth aspect of the present invention is a banknote deposit and withdrawal control method including: verifying banknotes inserted through a service aperture for performing a transaction of banknotes with a user; acquiring serial numbers of the banknotes; controlling conveyance of the banknotes in the device; and for each of one or more storage cassette in which banknotes are stored in the device, memorizing the serial numbers of banknotes stored in the storage cassette and a storage sequence of the banknotes as administration information in a memory section, wherein, the controlling includes, conveying a banknote to a corresponding storage cassette on the basis of a result of verification in the verifying, and recording the serial number of the banknote and the storage sequence of the banknote in the storage cassette as administration information in the memory section.

According to the above aspects of the present invention as described above, a banknote deposit and withdrawal device and banknote deposit and withdrawal control method may reliably and quickly differentiate the banknotes inserted by a customer and the banknotes from within the device, even in a case in which a fault occurs during a deposit transaction.

BRIEF DESCRIPTION OF THE DRAWINGS

Exemplary embodiments of the present invention will be described in detail based on the following figures, wherein:

FIG. 2 is a diagram describing serial number administration in the banknote deposit and withdrawal device in accordance with the present exemplary embodiment.

DETAILED DESCRIPTION OF THE INVENTION

Figure 1:
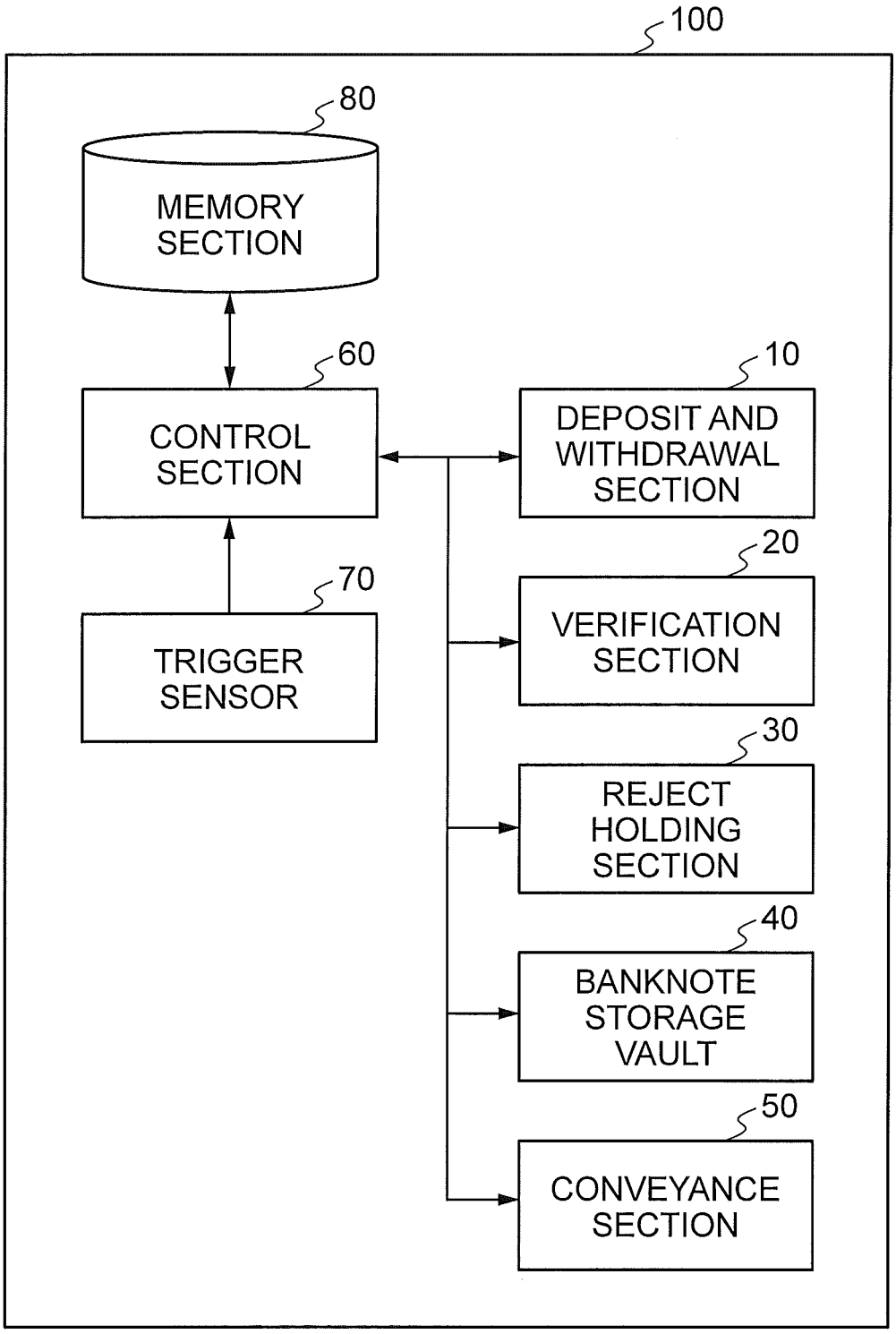
FIG. 1 is a block diagram illustrating a configuration of a banknote deposit and withdrawal device in accordance with an exemplary embodiment of the present invention.

Hereinbelow, preferred embodiments of the present invention are described in detail while referring to the attached drawings. In the present specification and drawings, elements that have essentially the same functional constitutions are assigned the same reference numerals and duplicative descriptions thereof are not given.

1. Configuration of Banknote Deposit and Withdrawal Device

First, configuration of a banknote deposit and withdrawal device according to an exemplary embodiment of the present invention is described on the basis of FIG. 1 and FIG. 2. FIG. 1 is a block diagram illustrating configuration of a banknote deposit and withdrawal device in accordance with the present exemplary embodiment. FIG. 2 is a descriptive diagram describing serial number administration in the banknote deposit and withdrawal device in accordance with the present exemplary embodiment.

A banknote deposit and withdrawal device 100 according to the present exemplary embodiment has a function of accepting banknotes inserted by customers, verifying the banknotes and counting numbers of the banknotes, and storing the banknotes in storage cassettes, and a function of when a payout is requested by a customer or a return is requested, counting numbers of banknotes and paying out the requested banknotes. More specifically, as illustrated in FIG. 1, the banknote deposit and withdrawal device 100 is equipped with a deposit and withdrawal section 10, a verification section 20, a reject holding section 30, a banknote storage vault 40, a conveyance section 50, a control section 60, a trigger sensor 70 and a memory section 80.

The deposit and withdrawal section 10 is a service unit that receives deposits of banknotes from customers and pays out withdrawals of banknotes to customers. The deposit and withdrawal section 10 includes a service aperture with a feed mechanism that feeds deposited banknotes and a stacking mechanism that stacks withdrawn banknotes. A shutter is provided that opens and closes when a customer inserts banknotes in the service aperture and when banknotes are to be delivered to a customer. The deposit and withdrawal section 10 is provided with a conveyance path that connects the service aperture with the other functional sections. Banknotes inserted at the service aperture are conveyed via the conveyance path to the reject holding section 30 (a reject holding unit) or the banknote storage vault 40 (storage cassettes), and banknotes stored in the reject holding section 30 or the banknote storage vault 40 are conveyed to the service aperture via the conveyance path.

The verification section 20 verifies the banknotes being conveyed along the conveyance path. The verification section 20 identifies, for example, whether banknotes are genuine or counterfeit, intact or damaged and the like, and identifies denominations, etc. The verification section 20 also detects multiple feeding, chain feeding, proximity, skew and the like. The verification section 20 also functions as a serial number acquisition section that uses character recognition, such as optical character recognition (OCR) or the like, to recognize and detect serial numbers of the banknotes being conveyed along the conveyance path.

The reject holding section 30 is a reject holding unit that stores rejected banknotes, forgotten banknotes and the like. As described below, the reject holding section 30 is equipped with a rejected media storage vault (see reference numeral 132 in FIG. 5) that stores banknotes identified as being multiply-fed due to a defect in feeding during a withdrawal process, and a forgotten media storage vault (see reference numeral 134 in FIG. 5) that stores banknotes left unclaimed at the service aperture by customers after a deposit transaction, a withdrawal transaction or the like. The rejected media storage vault and the forgotten media storage vault are each equipped with a stacking mechanism for stacking banknotes conveyed thereto.

The banknote storage vault 40 has storage cassettes that store banknotes that are proper according to the verification section 20, separated by, for example, denomination. For administration of respective banknotes of plural denominations, the banknote storage vault 40 is constituted by storage cassettes corresponding to the respective denominations. Each storage cassette includes a separation and stacking mechanism that separates and feeds out the banknotes one at a time, and that stacks banknotes conveyed thereto.

The conveyance section 50 is a mechanism that conveys the banknotes inside the banknote deposit and withdrawal device, and is constituted with, for example, a conveyance mechanism and a drive mechanism. The conveyance mechanism nips and feeds the banknotes with belts and rollers or the like. The drive mechanism drives the conveyance mechanism and a switching mechanism and the like. The switching mechanism is provided at respective branching portions of the conveyance path, and switches conveyance directions of the banknotes. Movements of banknotes between the deposit and withdrawal section 10 and the reject holding section 30 or banknote storage vault 40 and verifications of banknotes by the verification section 20 are enabled by functioning of the conveyance section 50.

The control section 60 controls the respective sections in accordance with instructions from a top-level apparatus of the banknote deposit and withdrawal device 100, and executes banknote processing such as banknote acceptance processing, storage processing, withdrawal processing and the like. For example, when the insertion of banknotes into the deposit and withdrawal section 10 is detected, the control section 60 causes the conveyance section 50 to function and convey the banknotes to the banknote storage vault 40, and causes the verification section 20 to verify the banknotes being conveyed along the conveyance path. The control section 60 administers banknotes stored into the banknote storage vault 40 from the deposit and withdrawal section 10 and banknotes withdrawn from the banknote storage vault 40, and memorizes, in the memory section 80, serial numbers of the banknotes and storage destinations and storage sequences of the banknotes.

The trigger sensor 70 is a sensor that detects thicknesses of the banknotes being conveyed along the conveyance path. In accordance with the banknote thicknesses detected by the trigger sensor 70, the control section 60 may check whether or not there is a defect in conveyance states of the banknotes and may alter conveyance destinations of the banknotes in accordance with the check results.

Various programs for realizing the functions of the banknote deposit and withdrawal device 100 are pre-memorized in the memory section 80, and administration information of the banknotes is memorized in the memory section 80. For example, the memory section 80 memorizes a banknote processing program, a banknote administration program and the like. The banknote processing program executes processes such as banknote withdrawal processing for a withdrawal transaction, banknote deposit processing for a deposit transaction, and the like in accordance with instructions from the top-level apparatus. The banknote administration program administers banknotes conveyed along the conveyance path and corrects defects when conveyance defects such as multiple feeding, chain feeding and the like of banknotes are detected by the verification section 20.

As administration information, the memory section 80 memorizes the serial numbers of banknotes identified by the verification section No. 20, storage destinations of the banknotes, and storage sequences in the storage destinations. An example of administration information is illustrated in FIG. 2. As illustrated in FIG. 2, the administration information is constituted with serial numbers of the banknotes stored in respective storage units (A to D) of the banknote storage vault 40. Here, the serial numbers are recorded in order of storage in the storage units. For example, the banknotes under Serial No. 1 in FIG. 2 are the banknotes that are stored in bottom positions of the storage cassettes, that is, the banknotes that were stored in the storage cassettes first. The serial numbers of the banknotes stored thereafter are indicated by, in order, Serial No. 2, Serial No. 3, etc. A storage cassette in which no banknotes are stored (storage cassette C in FIG. 2) has no administration information recorded. Execution of the programs memorized in the memory section 80 and processing for writing and reading administration information are implemented by, for example, the control section 60.

2. Banknote Return Processing in the Banknote Deposit and Withdrawal Device

Figure 3:
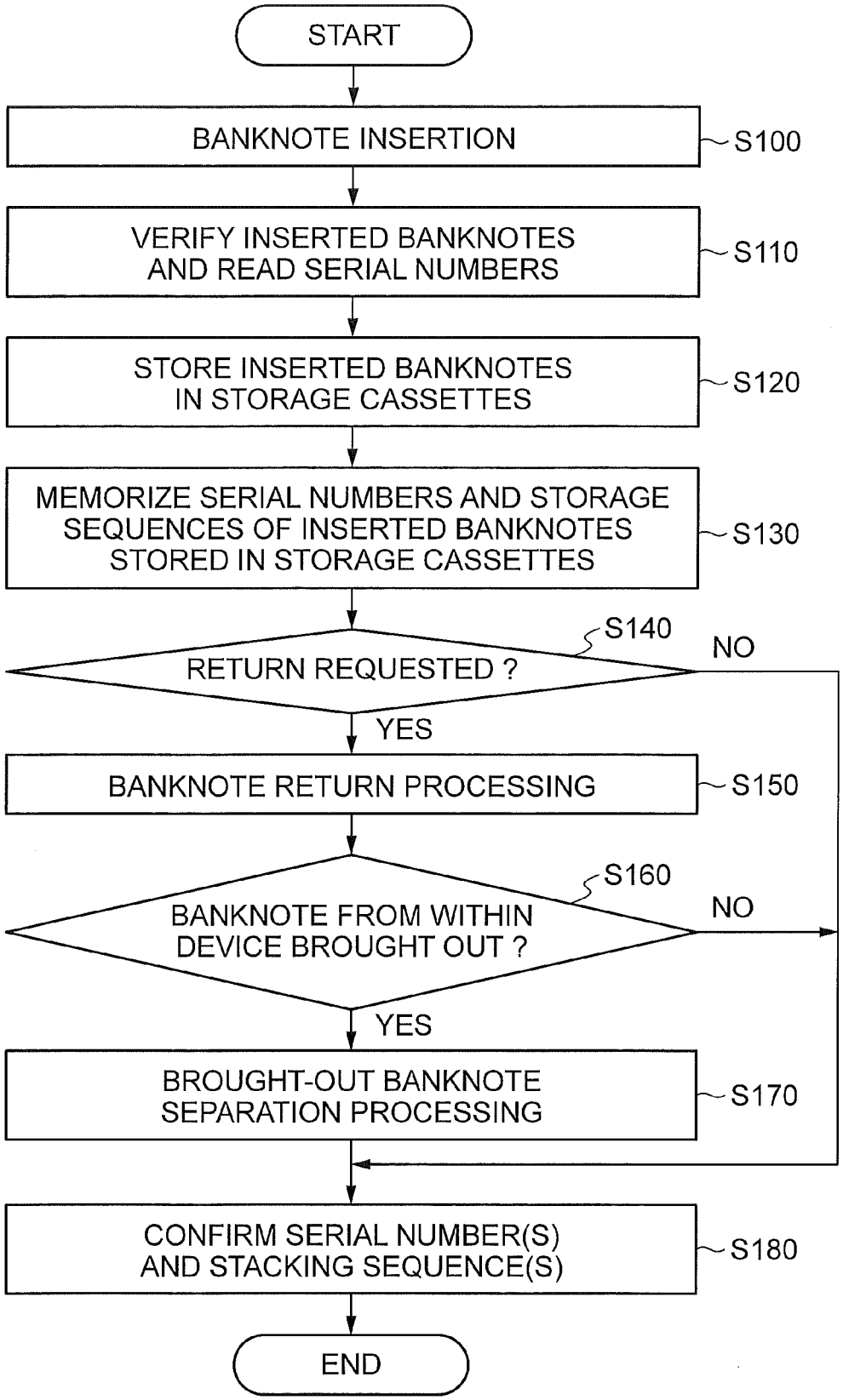
FIG. 3 is a flowchart illustrating banknote return processing by the banknote deposit and withdrawal device in accordance with the present exemplary embodiment.
Figure 4:
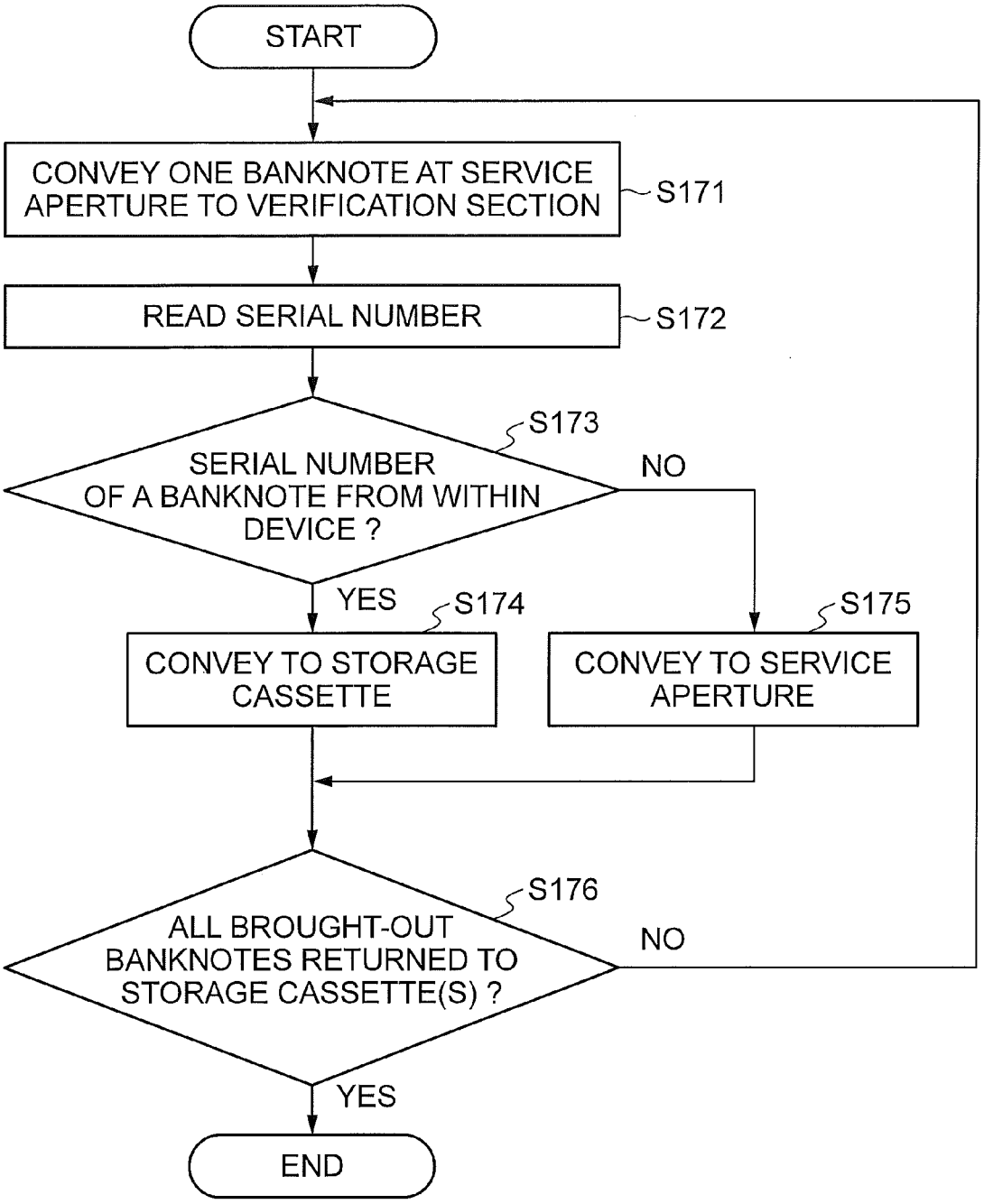
FIG. 4 is a flowchart illustrating details of the processing in step S170 of FIG. 3.

Next, banknote return processing by the banknote deposit and withdrawal device 100 according to the present exemplary embodiment is described on the basis of FIG. 3 and FIG. 4. FIG. 3 is a flowchart illustrating the banknote return processing by the banknote deposit and withdrawal device 100 in accordance with the present exemplary embodiment. FIG. 4 is a flowchart illustrating details of the processing in step S170 of FIG. 3. The term "banknote return processing" as used herein is intended to include processing that, when a customer requests the return of banknotes that the customer has inserted through the service aperture or when the device has a fault during a deposit transaction, returns the actual banknote(s) inserted via the service aperture to the customer.

When banknotes are being stored in the reject holding section 30 or the banknote storage vault 40, the banknote deposit and withdrawal device 100 according to the present exemplary embodiment reads the serial numbers of the banknotes verified by the verification section 20 and memorizes the serial numbers as administration information in the memory section 80 such that the storage sequences in the storage destinations may be identified. Thus, it is possible to specify the storage destination, conveyance state or the like of a banknote that is the same banknote as a banknote inserted by a customer. Therefore, in a case in which, for example, a fault such as a jam or the like occurs during a deposit transaction, just the banknotes that have been stacked in the storage cassettes by the current deposit transaction may be fed out and returned to the customer. Hereinbelow, descriptions are given in line with specific examples of a first banknote return process, for when a small number of banknotes are to be returned, and a second banknote return process, for when a large number of banknotes are to be returned. Either of the first banknote return process and the second banknote return process may be used regardless of the number of banknotes to be returned.

2-1. First Banknote Return Process

The first banknote return process of the banknote deposit and withdrawal device 100 according to the present exemplary embodiment is described on the basis of FIG. 3, FIG. 4, and FIG. 5 to FIG. 13. FIG. 5 to FIG. 13 are descriptive diagrams describing the first banknote return process of the banknote deposit and withdrawal device 100 in accordance with the present exemplary embodiment.

2-1-1. Structural Example of the Banknote Deposit and Withdrawal Device

Figure 5:
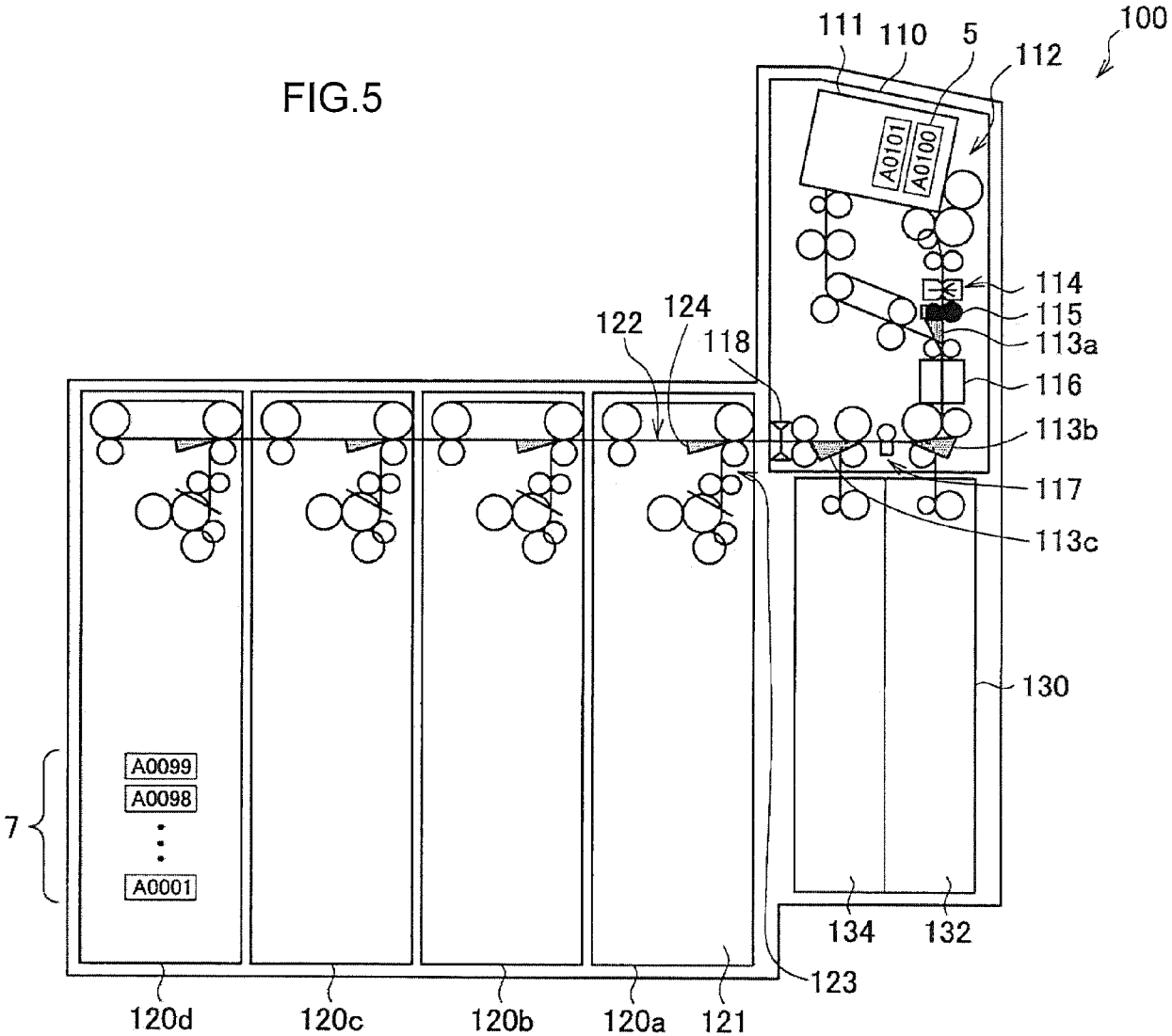
FIG. 5 is a diagram describing a first banknote return process of the banknote deposit and withdrawal device in accordance with the present exemplary embodiment.

Before the first banknote return process of the banknote deposit and withdrawal device 100 according to the present exemplary embodiment is described, a structural example of the banknote deposit and withdrawal device 100 according to the present exemplary embodiment is described on the basis of FIG. 5. As an example, as illustrated in FIG. 5, the banknote deposit and withdrawal device 100 according to the present exemplary embodiment is formed with a service unit 110, storage cassettes 120 (120*a* to 120*d*), and a reject holding unit 130.

The service unit 110 is a unit that transfers banknotes to and from users, and is equipped with a service aperture 111 and a conveyance path 112. The service aperture 111 includes a feeding mechanism that feeds out deposited banknotes and a stacking mechanism that stacks withdrawn banknotes. The conveyance path 112 connects the service aperture 111 with the storage cassettes 120 and the reject holding unit 130. On the path of the conveyance path 112 of the service unit 110, switching mechanisms 113*a*, 113*b* and 113*c*, a transmission-type image sensor 114, a thickness sensor 115, a reflection-type image sensor 116 and a magnetic sensor 117 are provided. The sensors are for identifying denominations of banknotes, whether the banknotes are genuine or counterfeit, and thicknesses and so forth. The transmission-type image sensor 114, thickness sensor 115, reflection-type image sensor 116 and magnetic sensor 117 are collectively referred to as the verification section 20. The reflection-type image sensor 116 functions as a serial number acquisition unit that acquires serial numbers of banknotes 5.

The service unit 110 according to the present exemplary embodiment is further provided with a thickness sensor 118 between the adjacent storage cassette 120*a* and the switching mechanism 113*c*. The thickness sensor 118 identifies thicknesses of banknotes withdrawn from the storage cassettes 120. The thickness sensor 118 may be constituted with a sensor the same as a running sensor that detects conveyance states of the banknotes (multiple feeding, chain feeding, proximity, skew and the like) or with a different sensor. These sensors are configured with, for example, a sensor component such as an optical sensor, an ultrasonic sensor, a magnetic sensor or the like, or with a combination of such a sensor component with a thickness detection mechanism such as a roller or the like. The thickness of banknotes being fed out from the storage cassettes 120*a* to 120*d* may be identified by this thickness sensor 118. Thus, there is no need to provide respective thickness sensors at each of the storage cassettes 120*a* to 120*d*. Therefore, a number of components in the device may be reduced, and the configuration may be simplified and a more inexpensive device may be realized.

The conveyance path 112 of the service unit 110 includes a conveyance path for banknotes being fed out from a banknote feed-out aperture of the service aperture 111 and a conveyance path for banknotes being fed into the banknote feed-out aperture of the service aperture 111. These conveyance paths are branched toward the service aperture 111 and merged toward the storage cassettes 120 by the first switching mechanism 113 a provided on the conveyance path 112 of the service unit 110. The second switching mechanism 113*b* and the third switching mechanism 113*c* are provided on the conveyance path 112 of the service unit 110 toward the storage cassette 120 side relative to the first switching mechanism 113*a*. The second switching mechanism 113*b* switches the conveyance path 112 such that defective banknotes with defects detected by the verification section 20 or thickness sensor 118 of the service unit 110 are conveyed toward the rejected media storage vault 132 of the reject holding unit 130. The third switching mechanism 113*c* switches the conveyance path 112 such that forgotten banknotes are conveyed from the service aperture 111 toward the forgotten media storage vault 134 of the reject holding unit 130.

The paths of travel of the banknotes may be switched by these switching mechanisms 113*a* to 113*c*. Therefore, flexibility in arrangement of the conveyance path 112 and of the sensors provided on the conveyance path 112 may be increased.

The transmission-type image sensor 114 structuring the verification section 20 of the service unit carries out banknote authenticity determination processing, and the thickness sensor 115 identifies multiple feeding of banknotes. The reflection-type image sensor 116 carries out, for example, number checks of the banknotes, and the actual banknotes may be administered in accordance with detection results from the reflection-type image sensor 116. The verification section 20 according to the present exemplary embodiment is constituted with these four sensors, but the present invention is not limited by this example and suitable modifications may be made in accordance with the verification processing. The sensors constituting the verification section 20 are disposed such that, sensors for which data processing takes time are closer to the service aperture 111. In the present exemplary embodiment, the transmission-type image sensor 114 used for the banknote authenticity determination is disposed closest to the service aperture 111. Data is acquired in order from data with higher priorities, and the processing may be completed before branch determination processing of a banknote. Thus, a reduction in length of conveyance paths (optimization) in the device as a whole may be achieved.

Because these sensors are disposed on the conveyance path 112, a banknote may be guided on a predetermined conveyance path to pass the sensors at required times in accordance with conveyance processing. Therefore, the conveyance path 112 may be shortened and simplified. Furthermore, because the service unit 110 according to the present exemplary embodiment is provided with the function of verifying the banknotes, there is no need to provide a separate verification section unit as in the conventional devices. Thus, a number of units structuring the device may be reduced, and the conveyance path may be shortened.

Each storage cassette 120 is equipped with a storage section 121, a first conveyance path 122 and a second conveyance path 123. The storage section 121 stores banknotes. The first conveyance path 122 may transfer banknotes two ways between the service unit 110 or the preceding storage cassette 120 and the succeeding storage cassette 120 or the like. The second conveyance path 123 is provided with a feeding mechanism that feeds out banknotes from the storage section 121 and a stacking mechanism that stacks banknotes in the storage section 121. The storage cassette 120 is also equipped with a switching mechanism 124 for switching between banknote conveyance destinations. The banknote deposit and withdrawal device 100 according to the present exemplary embodiment is provided in a state in which the four storage cassettes 120*a* to 120*d* are arrayed in a horizontal direction and have matching configurations. The number of storage cassettes 120 provided in the banknote deposit and withdrawal device 100 is not limited to this example. The storage cassettes 120 may be provided in accordance with, for example, a number of kinds of banknote. Moreover, in one or more of the storage cassettes 120*a* to 120*d*, the switching mechanism 124 of that storage cassette 120 may be a switching mechanism that is capable of switching travel of the banknotes between three directions.

The reject holding unit 130 is equipped with the rejected media storage vault 132 and the forgotten media storage vault 134. The rejected media storage vault 132 stores banknotes identified as being multiply fed out by defective feeding during withdrawal processing. The forgotten media storage vault 134 stores banknotes forgotten by users. Rejected banknotes and forgotten banknotes and the like are stored in the reject holding unit 130 by switching by the switching mechanisms 113*b* and 113*c* of the service unit 110.

In the banknote deposit and withdrawal device 100 according to the present exemplary embodiment, the reject holding unit 130 is disposed, for example, below the service unit 110, and the storage cassette 120*a* is disposed such that a lower portion side of a side face of the service unit 110 opposes an upper portion side of a side face of the storage cassette 120*a*. The storage cassettes 120*a* to 120*d* are disposed to be adjacent in the horizontal direction as mentioned above. With this arrangement of the service unit 110, the storage cassettes 120*a* to 120*d* and the reject holding unit 130, banknotes for which defects are detected in the process of conveyance of the banknotes in the service unit 110, banknotes forgotten by users and the like may be conveyed to the reject holding unit 130, and just banknotes that are storable in the storage cassettes 120 may be conveyed to the storage cassettes 120. The first conveyance paths 122 of the cassettes at the upper sides of the storage cassettes 120*a* to 120*d* link up. Thus, the conveyed banknotes may be conveyed to and stored in the corresponding storage cassettes 120 without a separate conveyance unit being provided.

The banknote deposit and withdrawal device 100 according to the present exemplary embodiment may embody the processing required of the device with a small number of structural units. Because the number of units structuring the device is reduced, banknote conveyance path lengths may be shortened, and components such as conveyance motors, conveyance rollers, driving transmission components, conveyance guides, running sensors and the like may be reduced in number. Therefore, configuration of the device may be simplified and an inexpensive device may be realized. Furthermore, because the number of units is reduced, there may be fewer locations at which unit opening/closing operations, jam removal operations and the like are required, and usability may be improved. Further yet, because the conveyance path lengths are shortened, noise produced by the device may be reduced.

Because the units are disposed such that there are no units above the storage cassettes 120, usability in regard to installing and removing the storage cassettes 120 is improved. In addition, there is no need to separately extract upper units and lower units, and there is no need to provide respective rail members, locking mechanism members and the like. In a case in which a circuit board that controls operations of upper units and a circuit board that controls operations of lower units would be separately provided, these circuit boards may be united. Therefore, cables connecting with electronic components whose functions would be duplicated and between circuit boards and the like, and cable guides and the like, may be omitted. Thus, the configuration of the device may be simplified and an inexpensive device may be realized. There is a further advantage in that, in a case in which more storage cassettes are to be provided to meet the needs of a user, this may be achieved with minimal changes.

In the banknote deposit and withdrawal device 100 according to the present exemplary embodiment, thickness sensors that identify thicknesses of banknotes being fed out from the storage cassettes 120 are collectively constituted by the single sensor in the service unit 110. Therefore, a number of components of the device may be reduced, and a simplified, inexpensive device may be realized.

2-1-2. Banknote Return Processing

Next, the first banknote return process of the banknote deposit and withdrawal device 100 according to the present exemplary embodiment is described specifically. First, as illustrated in FIG. 3, banknotes 5 are inserted into the service aperture 111 of the banknote deposit and withdrawal device 100 (S100). For example, as illustrated in FIG. 5, the banknotes 5 with the serial numbers A0100 and A0101, which should be stored in the storage cassette 120*d*, are inserted into the service aperture 111 of the banknote deposit and withdrawal device 100. At this time, the banknotes 5 with the serial numbers A0001, . . . , A0098, A0099 have already been stored in the storage cassette 120*d*.

Each banknote 5 inserted into the service aperture 111 (hereinafter referred to as an inserted banknote 6) is conveyed along the conveyance path 112 and is verified by the transmission-type image sensor 114, the thickness sensor 115, the reflection-type image sensor 116 and the magnetic sensor 117 in the service unit 110 provided on the conveyance path, and the serial number of each inserted banknote 6 being conveyed is read (S110). The control section 60 of the banknote deposit and withdrawal device 100 controls driving of the conveyance section 50, on the basis of verification results from the verification section 20, and stores the inserted banknote 6 in the storage cassette 120 that corresponds to the denomination of the inserted banknote 6 (S120). For example, in the case illustrated in FIG. 5 in which the inserted banknotes 6 with the serial numbers A0100 and A0101 are to be stored in the storage cassette 120*d*, the control section 60 controls driving of the conveyance section 50 to store the inserted banknotes 6 with the serial numbers A0100 and A0101 in the storage cassette 120*d*, as illustrated in FIG. 6.

The control section 60 of the banknote deposit and withdrawal device 100 memorizes the serial number of each inserted banknote 6 read in step S110 in the memory section 80 together with a stacking sequence of the inserted banknote 6 in the storage destination (S130). For example, when the inserted banknotes 6 with the serial numbers A0100 and A0101 are stored in the storage cassette 120*d*, as illustrated in FIG. 6, the control section 60 records the serial numbers A0100 and A0101 of the inserted banknotes 6 subsequent to the serial numbers A0001, . . . , A0098, A0099 of the banknotes 5 that have already been stored in the storage cassette 120*d* (hereinafter referred to as banknotes from within the device 7) in the memory section 80, as administration information (banknote serial numbers and storage sequences) relating to the storage cassette 12*d*. Here, the serial number A0099 of the banknote from within the device 7 that is disposed in the topmost position (that is, was stored most recently), among the banknotes from within the device 7, before the inserted banknotes 6 are deposited, and the serial numbers A0100 and A0101 of the inserted banknotes 6 are memorized as different sets of administration information. Thus, the control section 60 may monitor a boundary between the inserted banknotes 6 and banknotes from within the device 7 that are stacked in the storage cassette 120*d*.

Then, the control section 60 of the banknote deposit and withdrawal device 100 makes the determination as to whether there is a return request for the inserted banknotes 6, before the transaction is confirmed (S140). The meaning of the term "return request" in step S140 may be considered to include a return request from the customer who has deposited the inserted banknotes 6, a return command from the control section 60 due to a fault in the device during the deposit transaction, and the like. In a case in which there is a return request for the inserted banknotes 6 before the deposit transaction is confirmed, banknote return processing is executed (S150).

Figure 6:
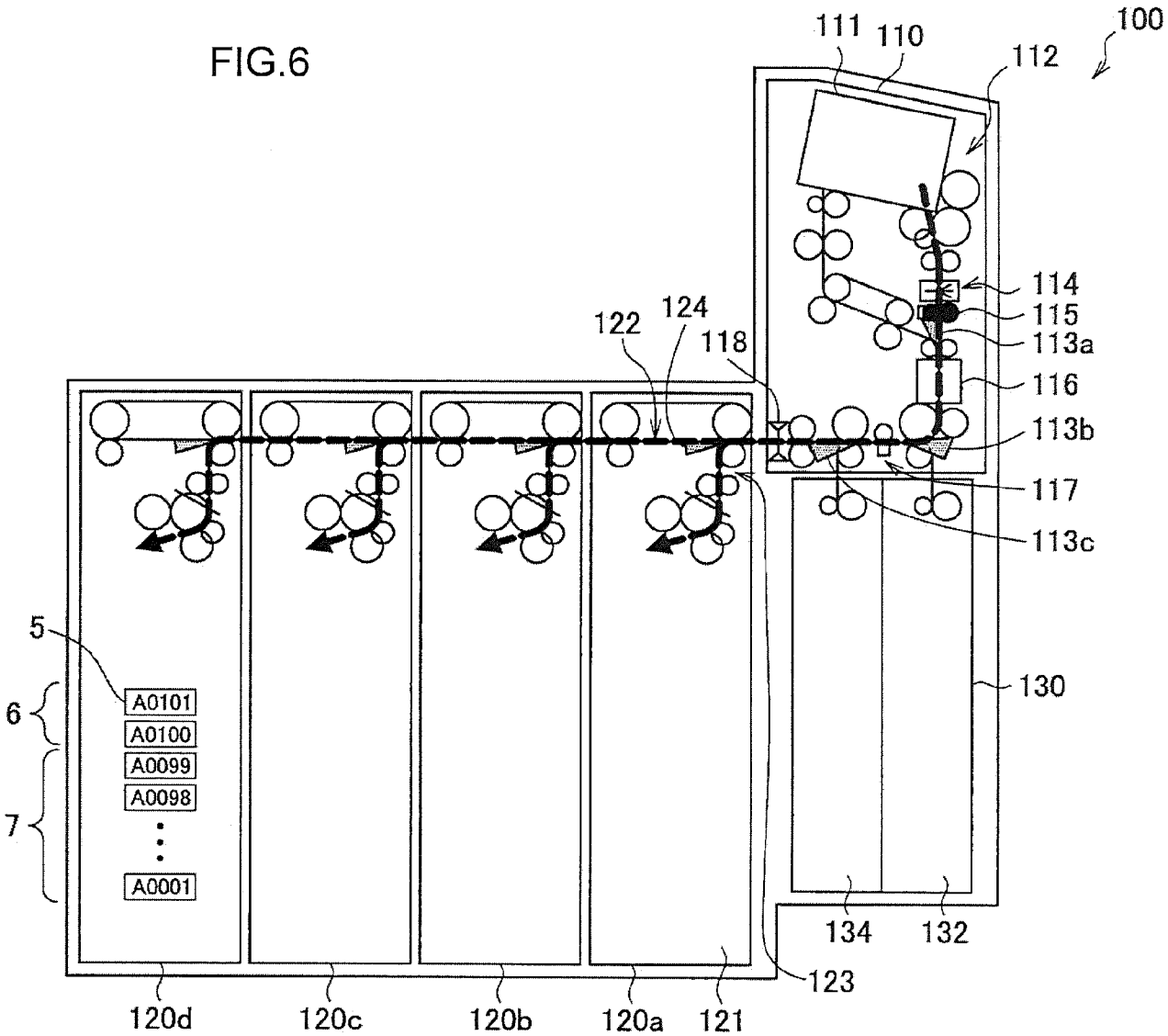
FIG. 6 is a diagram describing the first banknote return process of the banknote deposit and withdrawal device in accordance with the present exemplary embodiment.

For example, in a case in which the inserted banknotes 6 have been stored in the storage cassette 120*d* as in FIG. 6, in order to convey the inserted banknotes 6 from the storage cassette 120*d* to the service aperture 111 of the service unit 110, the control section 60 first causes the inserted banknotes 6 with the serial numbers A0100 and A0101 to be fed out from the storage cassette 120*d*, and then the inserted banknotes 6 are conveyed through the first conveyance paths 122 of the storage cassettes 120*c* to 120*a* to the service unit 110.

Thicknesses of the inserted banknotes 6 conveyed to the service unit 110 are detected by the thickness sensor 118 and the serial numbers of the inserted banknotes 6 conveyed from the storage cassette 120*d* to the service aperture 111 are read by the verification section 20. The control section 60 uses at least one of these sets of information to determine whether or not a banknote from within the device 7 is being mistakenly conveyed to the service aperture 111 together with the inserted banknotes 6 (S160). That is, in step S160, a determination is made as to whether any of the banknotes from within the device 7 that should be left stored in the storage cassette 120*d* have been brought out together with the inserted banknotes 6 that should be conveyed, due to multiple feeding or the like.

Whether any of the banknotes from within the device 7 have been brought out or not may be determined from, for example, whether or not a thickness detected by the thickness sensor 118 is greater than a thickness corresponding to a single banknote 5. In a case in which a thickness detected by the thickness sensor 118 is greater than the thickness corresponding to a single banknote 5, the likelihood that plural banknotes 5 are being multiply conveyed is high, and it may be determined that a banknote from within the device 7 has been brought out with the inserted banknotes 6. Alternatively, on the basis of the serial numbers acquired by the verification section 20, it may be determined whether or not a serial number other than the serial numbers of the inserted banknotes 6 has been acquired. In a case in which there is a serial number other than the serial numbers of the inserted banknotes 6, it may be determined that a banknote from within the device 7 has been brought out with the inserted banknotes 6.

Figure 7:
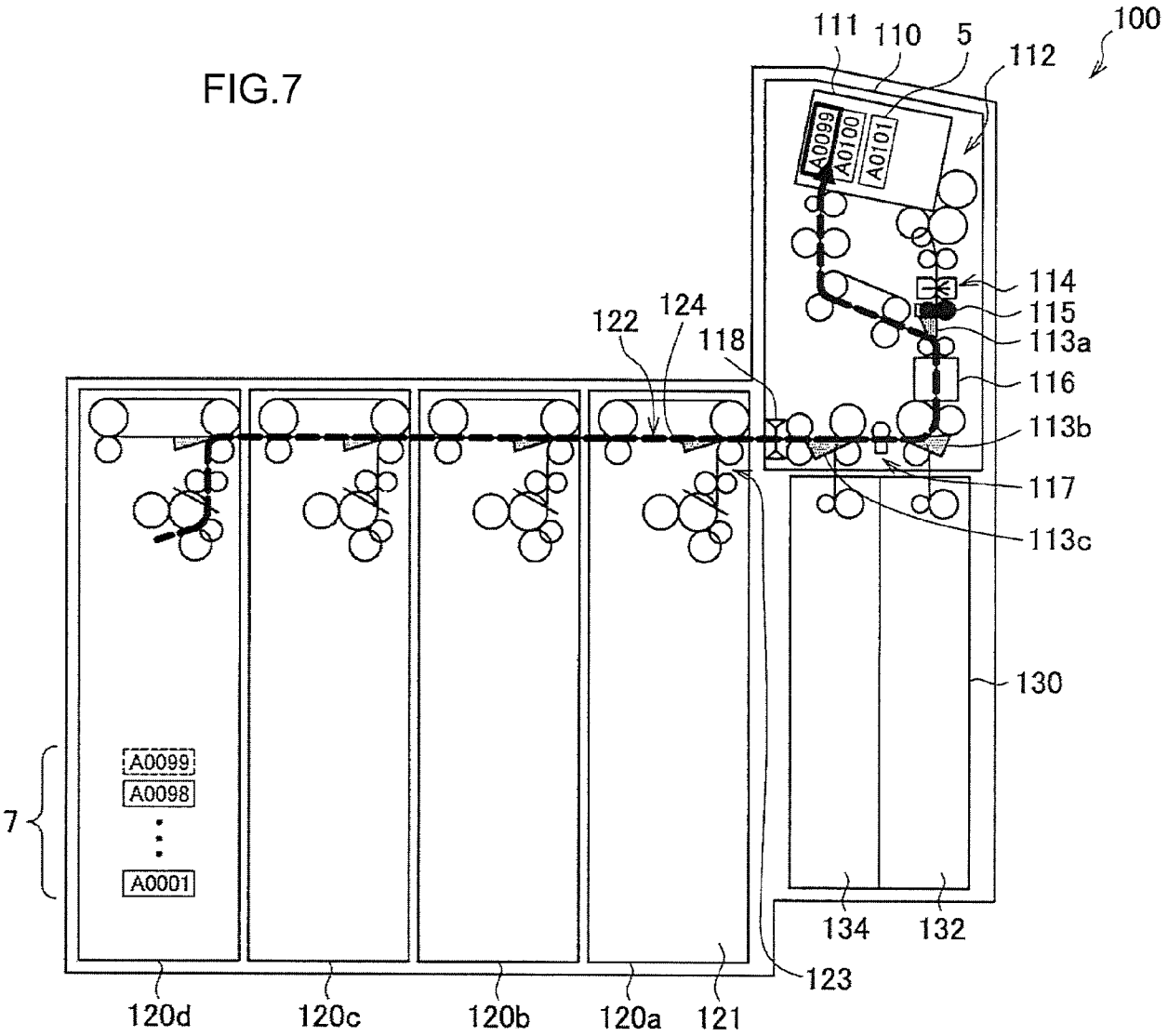
FIG. 7 is a diagram describing the first banknote return process of the banknote deposit and withdrawal device in accordance with the present exemplary embodiment.

In a case in which it is determined in step 160 that any of the banknotes from within the device 7 that should be left stored in the storage cassette 120*d* has been brought out, the control section 60 performs processing (S170) to separate the banknote from within the device 7 that has been brought out from the inserted banknotes 6 that have just been deposited and should be returned, and to store the banknote from within the device 7 back in the storage cassette 120*d* (S170). For example, as illustrated in FIG. 7, the banknote from within the device 7 with the serial number A0099 has been brought out. The banknote from within the device 7 with the serial number A0099 was adjacent to, of the inserted banknotes 6 just deposited, the inserted banknote 6 with the serial number A0100 that was stored in the storage cassette 120*d* first. The banknote from within the device 7 with the serial number A0099 is not one of the inserted banknotes 6 that should be returned to the customer. Therefore, by the processing of step S170, the banknote from within the device 7 with the serial number A0099 is conveyed to and stored in the storage cassette 120*d* in which it was originally stored.

For the processing to separate the banknote from within the device 7 that has been brought out, as illustrated in FIG. 4, first, one of the banknotes 5 at the service aperture 111 is conveyed to the verification section 20 (S171). For example, for the banknotes 5 in the service aperture 111 illustrated in FIG. 7, the control section 60 feeds out the one banknote 5 at the banknote feed-out aperture side of the service aperture 111 (that is, the inserted banknote 6 with the serial number A0101 in FIG. 7) and conveys the banknote 5 away from the banknote feed-out aperture. The single banknote 5 conveyed away from the service aperture 111 is conveyed to the verification section 20, and its serial number is read (S172). Then, the control section 60 makes a determination (S173) as to whether the serial number of the banknote 5 read in step S172 is the serial number of a banknote from within the device 7 that was previously stored in the banknote deposit and withdrawal device 100. Here, the control section 60 refers to the serial numbers and storage sequences or the like of the banknotes memorized as administration information in the memory section 80, and determines whether or not the serial number of the banknote 5 read in step S172 matches the serial number (administration information) of any banknote from within the device 7. Alternatively, the control section 60 may make a determination as to whether the serial number of the banknote 5 read in step S172 matches the serial number (administration information) of any of the inserted banknotes 6.

In a case in which the serial number of the banknote 5 read in step S172 does not match the serial number of any of the inserted banknotes 6 in step S173 (in other words, the serial number matches the serial number of any of the banknotes from within the device 7 in the administration information), it is determined that this banknote 5 is not one of the inserted banknotes 6, and the banknote 5 is conveyed to the storage cassette 120 in which it was originally stored (S174). On the other hand, in a case in which the serial number of the banknote 5 read in step S172 matches the serial number of any of the inserted banknotes 6 in step S173 (in other words, the serial number does not match the serial number of any of the banknotes from within the device 7 in the administration information), it is determined that the banknote 5 is one of the inserted banknotes 6, and the banknote 5 is conveyed to the service aperture 111 (S175).

When the check of the serial number of one of the banknotes 5 has been completed, the control section 60 makes a determination (S176) as to whether all the brought-out banknotes from within the device 7 among the banknotes 5 stored at the service aperture 111 have been returned to the storage cassettes 120. Whether all the brought-out banknotes from within the device 7 have been returned to the storage cassettes 120 or not may be determined from the serial numbers of the banknotes 5 that have been conveyed from the storage cassettes 120 to the service aperture 111. In a case in which it is determined in step S176 that there is a brought-out banknote from within the device 7 that has not yet been returned to the storage cassettes 120, the processing is repeated from step S171. On the other hand, in a case in which it is determined in step S176 that all of the brought-out banknotes from within the device 7 have been returned to the storage cassettes 120, the processing of FIG. 4 ends and the processing of step S180 in FIG. 3 is executed.

Figure 8:
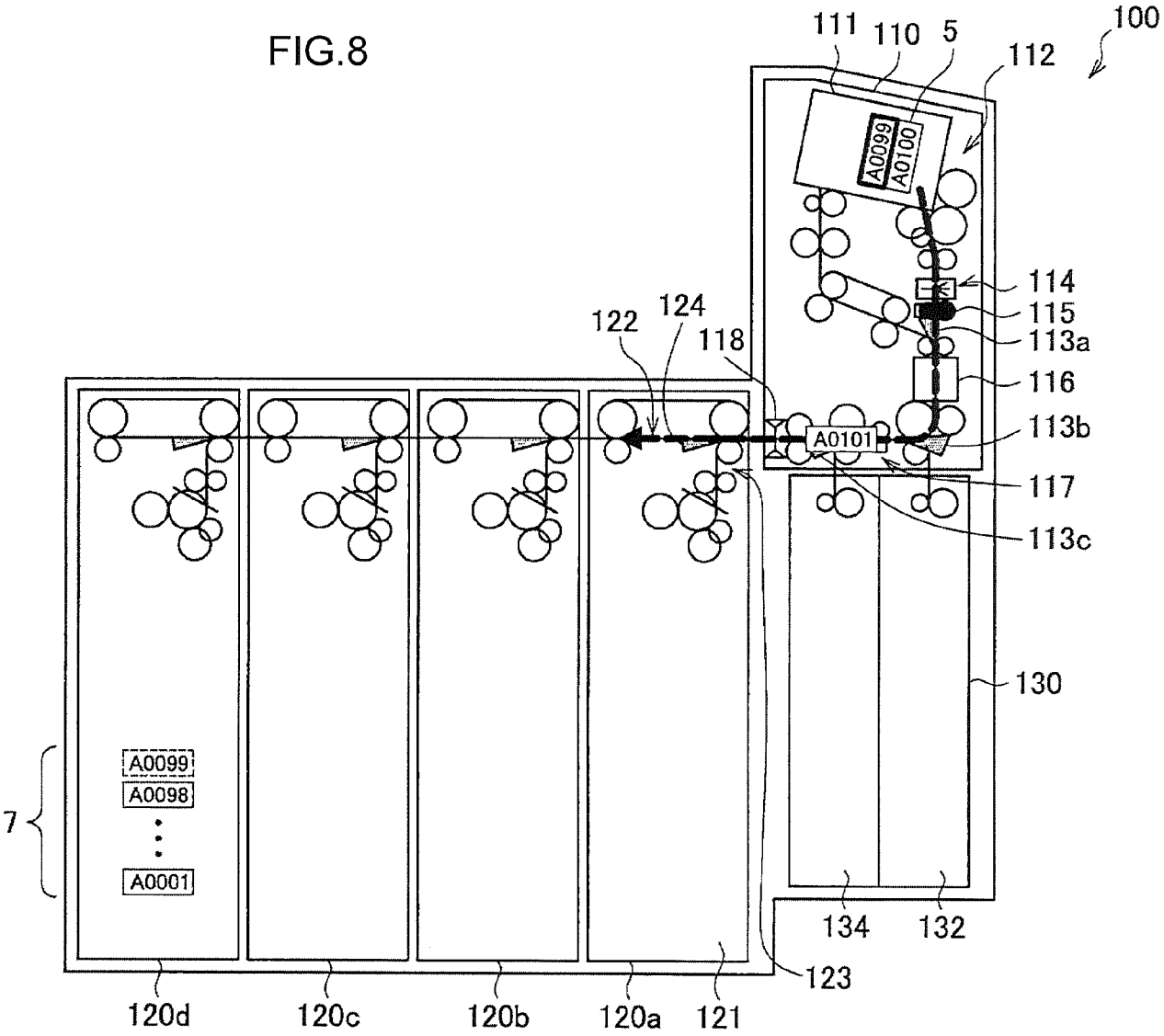
FIG. 8 is a diagram describing the first banknote return process of the banknote deposit and withdrawal device in accordance with the present exemplary embodiment.
Figure 9:
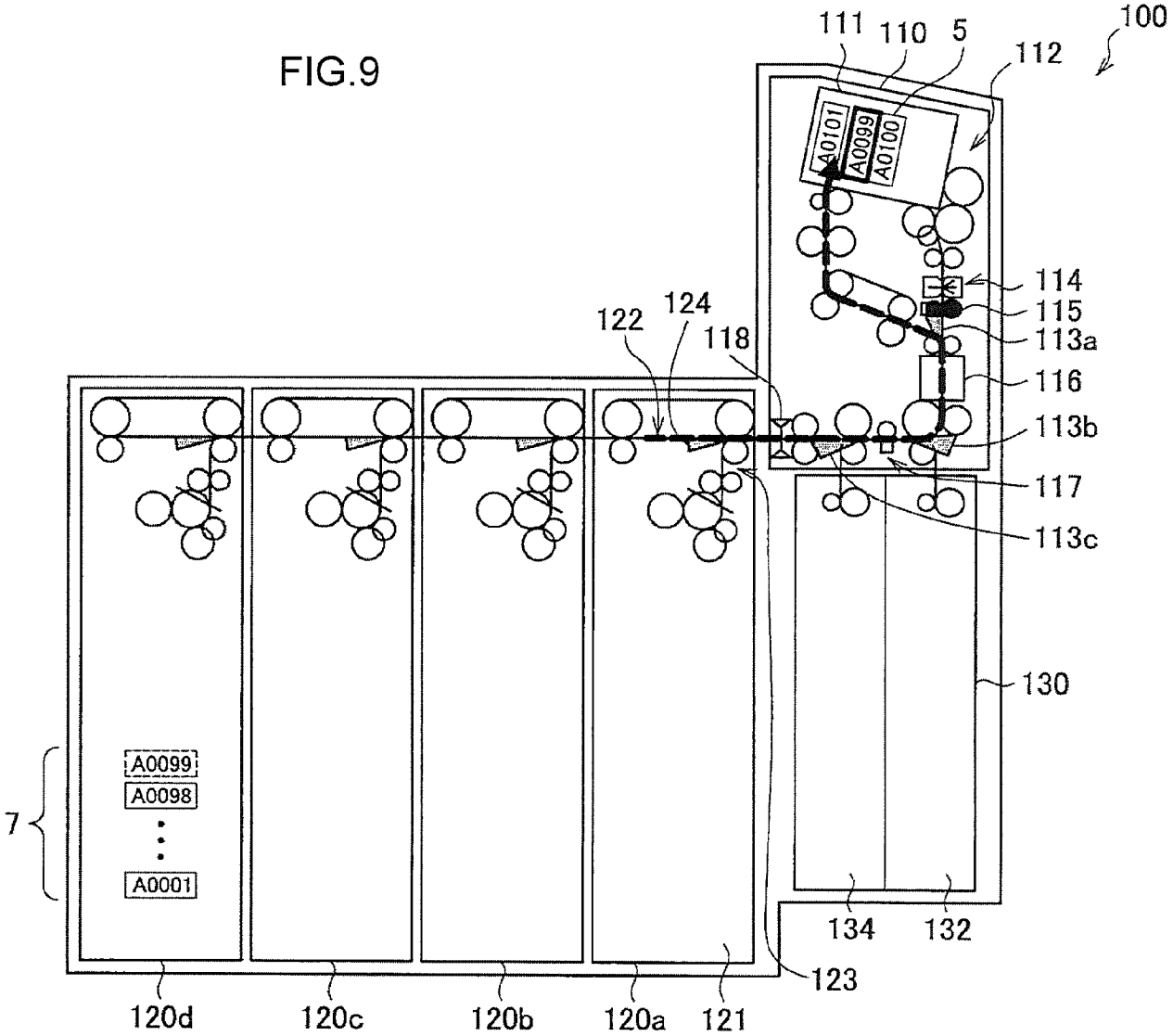
FIG. 9 is a diagram describing the first banknote return process of the banknote deposit and withdrawal device in accordance with the present exemplary embodiment.

For example, in the example illustrated in FIG. 7, the banknote 5 with the serial number A0101 that is at the banknote feed-out aperture side of the service aperture 111 as illustrated in FIG. 8 is fed out and conveyed to the conveyance path 112. When the serial number is read at the verification section 20, the processing for matching with the serial numbers administered in the administration information is carried out. The banknote 5 with the serial number A0101 is one of the inserted banknotes 6 that have just been deposited. Therefore, as illustrated in FIG. 9, the control section 60 switchbacks the banknote 5 with the serial number A0101 that has been conveyed to the thickness sensor 118 and feeds it along the conveyance path 112 of the service aperture 111 and through the banknote feed-in aperture to the service aperture 111. Thus, inside the service aperture 111, the banknotes 5 with the serial numbers A0100, A0099 and A0101 are stored in this order from the banknote feed-out aperture side. At this time, the brought-out banknote A0099 has not yet been returned to the storage cassette 120*d*. Therefore, the control section 60 continues the processing to check the banknote 5 with the serial number A0100 that is at the banknote feed-out aperture side of the service aperture 111.

Figure 10:
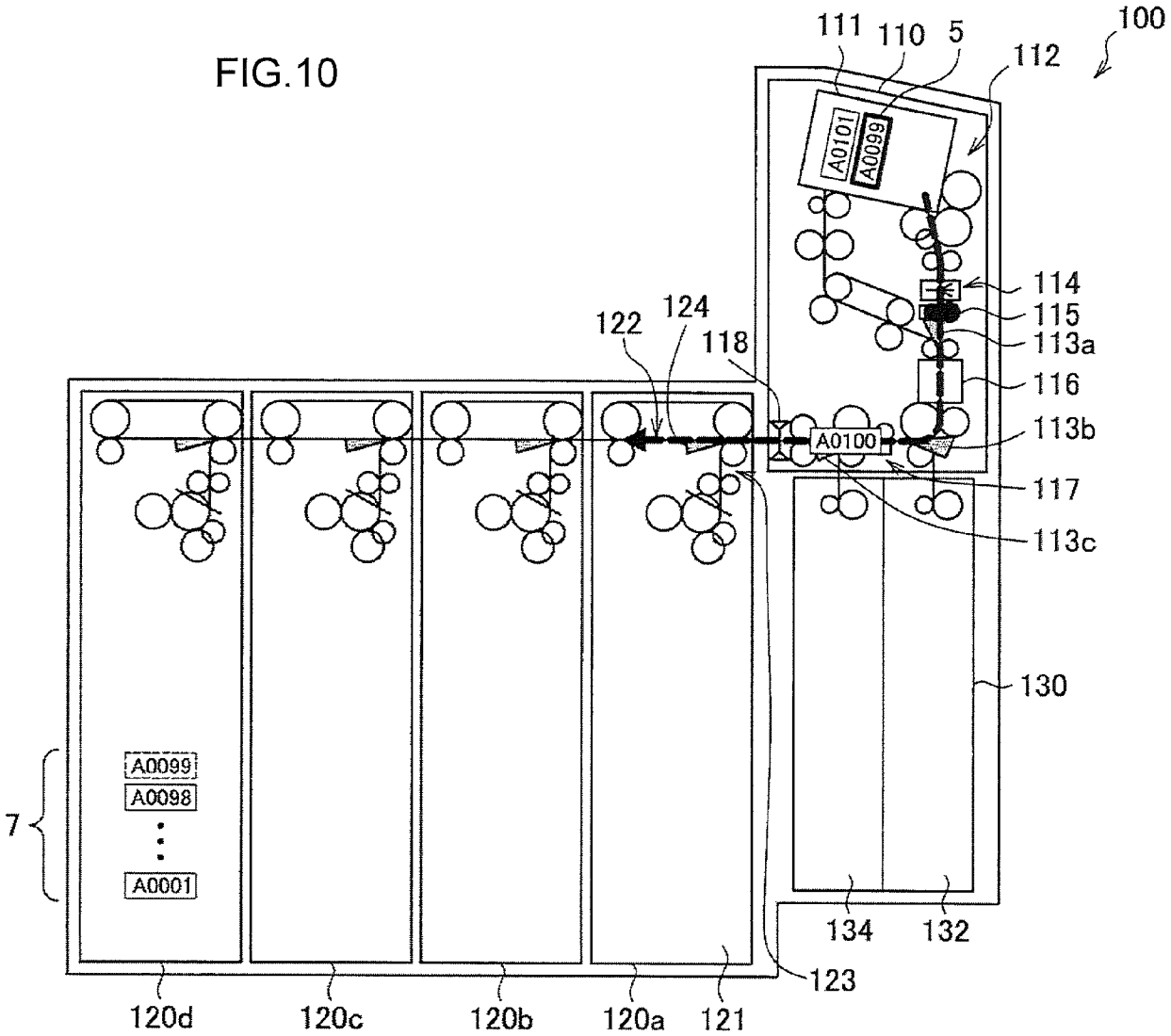
FIG. 10 is a diagram describing the first banknote return process of the banknote deposit and withdrawal device in accordance with the present exemplary embodiment.
Figure 11:
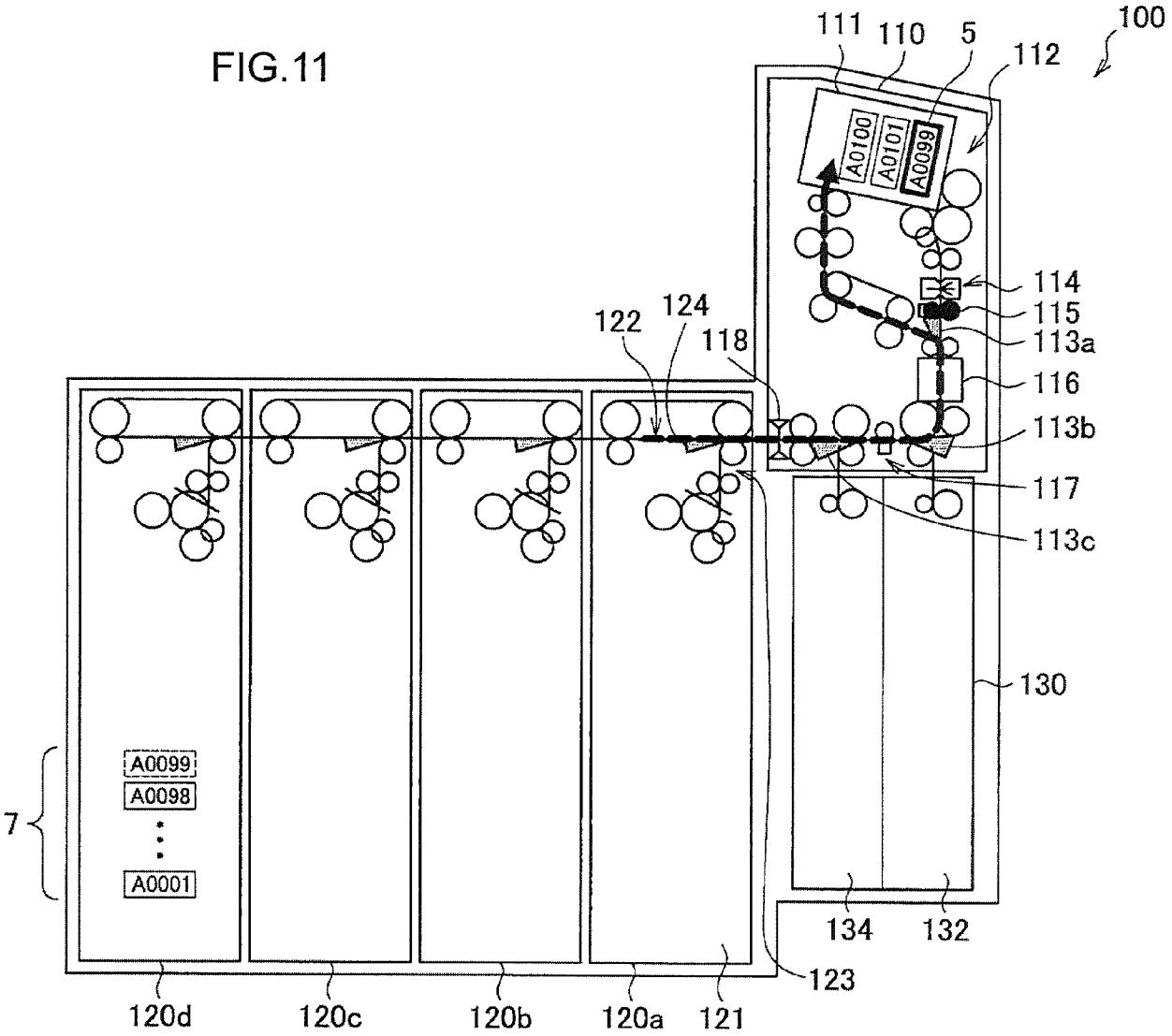
FIG. 11 is a diagram describing the first banknote return process of the banknote deposit and withdrawal device in accordance with the present exemplary embodiment.

As illustrated in FIG. 10, the banknote 5 with the serial number A0100 that is at the banknote feed-out aperture side of the service aperture 111 is fed out and conveyed to the conveyance path 112. When the serial number is read at the verification section 20, the processing for matching with the serial numbers administered in the administration information is carried out. The banknote 5 with the serial number A0100 is also one of the inserted banknotes 6 that have just been deposited. Therefore, as illustrated in FIG. 11, the control section 60 switchbacks the banknote 5 with the serial number A0100 that has been conveyed to the thickness sensor 118 and feeds it along the conveyance path 112 of the service aperture 111 and through the banknote feed-in aperture to the service aperture 111. Thus, inside the service aperture 111, the banknotes 5 with the serial numbers A0099, A0101 and A0100 are stored in this order from the banknote feed-out aperture side. At this time too, the brought-out banknote A0099 has not yet been returned to the storage cassette 120*d*. Therefore, the control section 60 continues the processing to check the banknote 5 with the serial number A0099 that is at the banknote feed-out aperture side of the service aperture 111.

Figure 12:
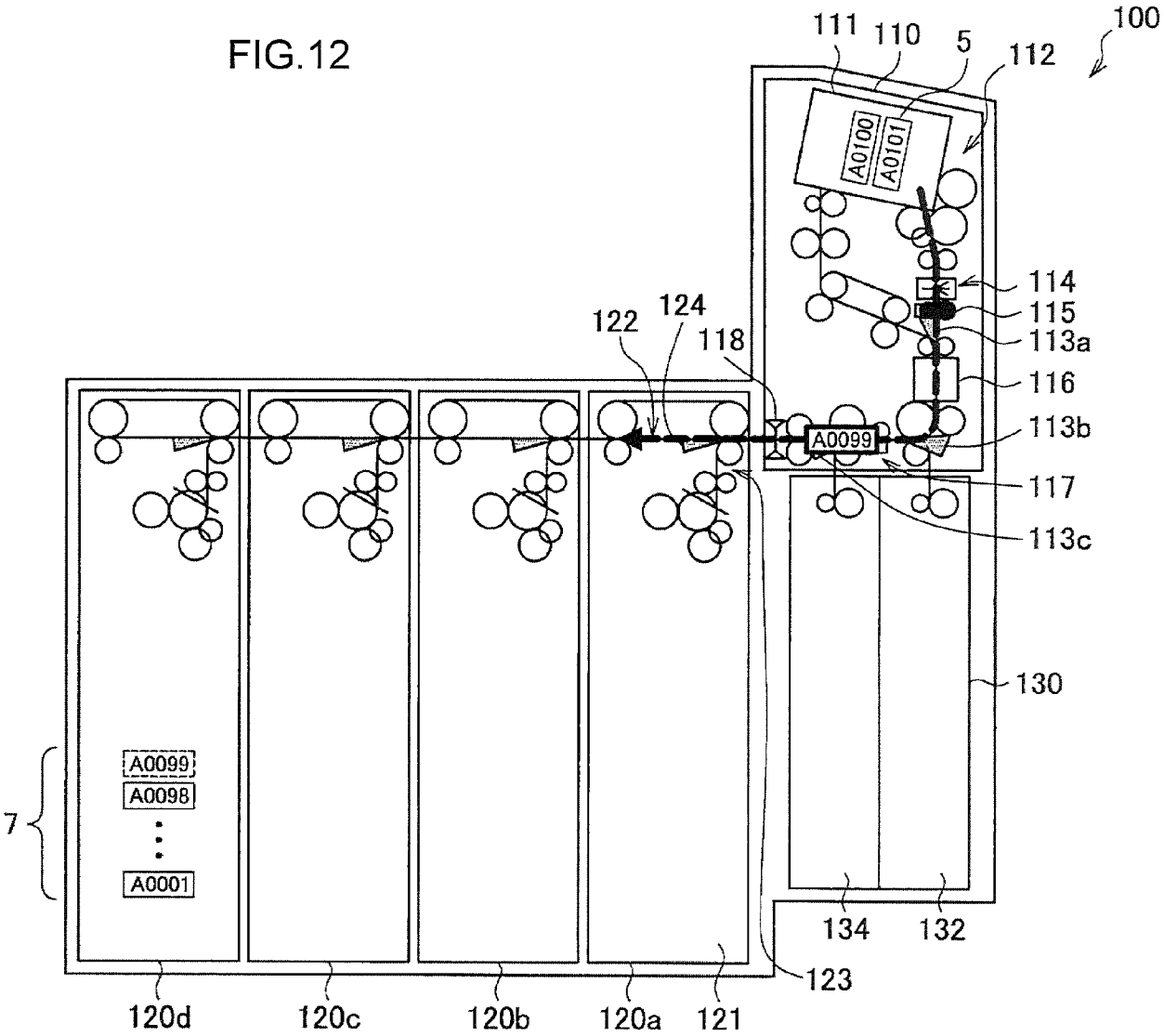
FIG. 12 is a diagram describing the first banknote return process of the banknote deposit and withdrawal device in accordance with the present exemplary embodiment.
Figure 13:
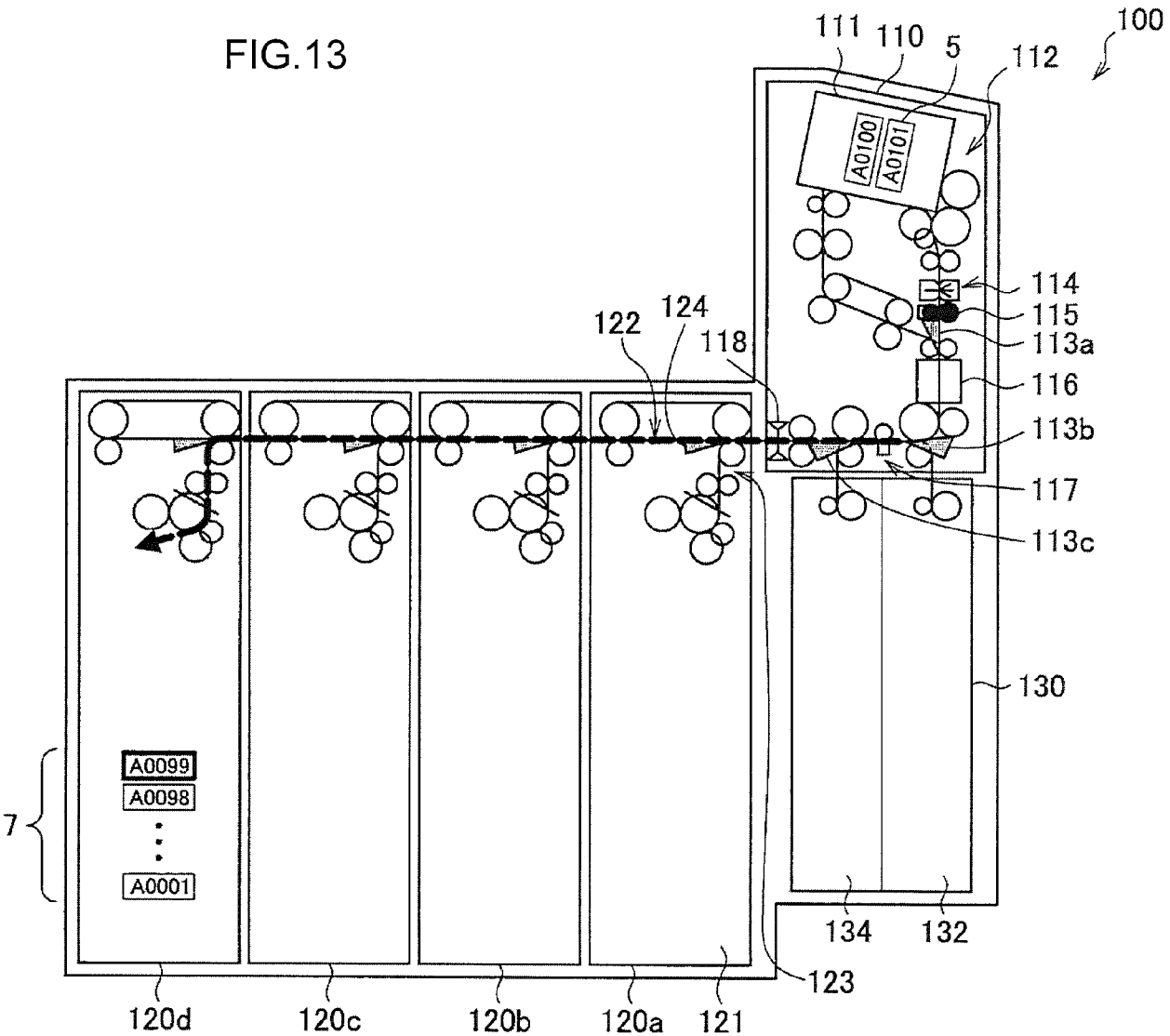
FIG. 13 is a diagram describing the first banknote return process of the banknote deposit and withdrawal device in accordance with the present exemplary embodiment.

As illustrated in FIG. 12, the banknote 5 with the serial number A0099 that is at the banknote feed-out aperture side of the service aperture 111 is fed out and conveyed to the conveyance path 112. When the serial number is read at the verification section 20, the processing for matching with the serial numbers administered in the administration information is carried out. The banknote 5 with the serial number A0099 is one of the banknotes from within the device 7 that were previously stored in the storage cassette 120*d*. Therefore, as illustrated in FIG. 13, the control section 60 stores this banknote 5 (serial number A0099) into the storage cassette 120*d* via the first conveyance paths 122 of the storage cassettes 120*a* to 120*d*. Thus, the banknotes from within the device 7 that have been brought out may be conveyed to the storage cassettes 120 in accordance with the banknote serial numbers and the storage sequences of the banknotes in the storage cassettes 120. In this case, every brought-out banknote from within the device 7 is returned to the storage cassette 120*d*.

Returning now to the description of FIG. 3, when all the banknotes from within the device 7 that have been brought out have been returned to the storage cassettes 120 in step S170, the serial numbers and storage sequences of the banknotes from within the device 7 that have just been stored in the storage cassettes 120 are confirmed (S180). Accordingly, the administration information in the memory section 80 (serial numbers and storage sequences of the banknotes from within the device 7) is updated. In a case in which the inserted banknotes 6 have been returned to the customer by the processing of steps S150 to S170, the administration information is confirmed as being in the state prior to the current deposit transaction. On the other hand, in a case in which there is no return request for the banknotes 5 in step S140 or it has been determined in step S160 that no banknote has been brought out, the administration information (serial numbers and storage sequences of the banknotes from within the device 7) is updated by step S180 to information that includes any inserted banknotes 6 that have just been deposited. Thus, the banknotes from within the device 7 currently stored in the storage cassettes 120 may be accurately monitored.

The first banknote return process has been described hereabove. The banknote deposit and withdrawal device 100 according to the present exemplary embodiment memorizes the serial numbers and storage sequences of the banknotes from within the device 7 stored in the storage cassettes 120 as attribute information in the memory section 80 at times of deposit transactions of the banknotes 5. Until a transaction is completed, the inserted banknotes 6 that are currently being deposited and the banknotes from within the device 7 that were already stored in the storage cassettes 120 are differentiated. In the first banknote return process, when a return request for the inserted banknotes 6 is received and the inserted banknotes 6 that have been stored into the storage cassettes 120 are conveyed to the service aperture 111, in a case in which it is detected by the thickness sensor 118 that a banknote from within the device 7 that is not an object of return has been brought out together with the just-deposited inserted banknotes 6, the control section 60 reads the serial numbers of the banknotes 5 that have been conveyed to the service aperture 111, one at a time. In accordance with the administration information memorized in the memory section 80, the control section 60 identifies the banknotes from within the device 7 that have been brought out, and returns the same to the storage cassettes 120. Thus, there is no need for all the banknotes from within the device 7 that are in the storage cassettes 120 to be re-verified; only the inserted banknotes 6 inserted in the current deposit transaction and the brought-out banknotes from within the device 7 are re-verified. Therefore, the inserted banknotes 6 from the customer may be identified in a short time.

2-2. Second Banknote Return Process

Figure 14:
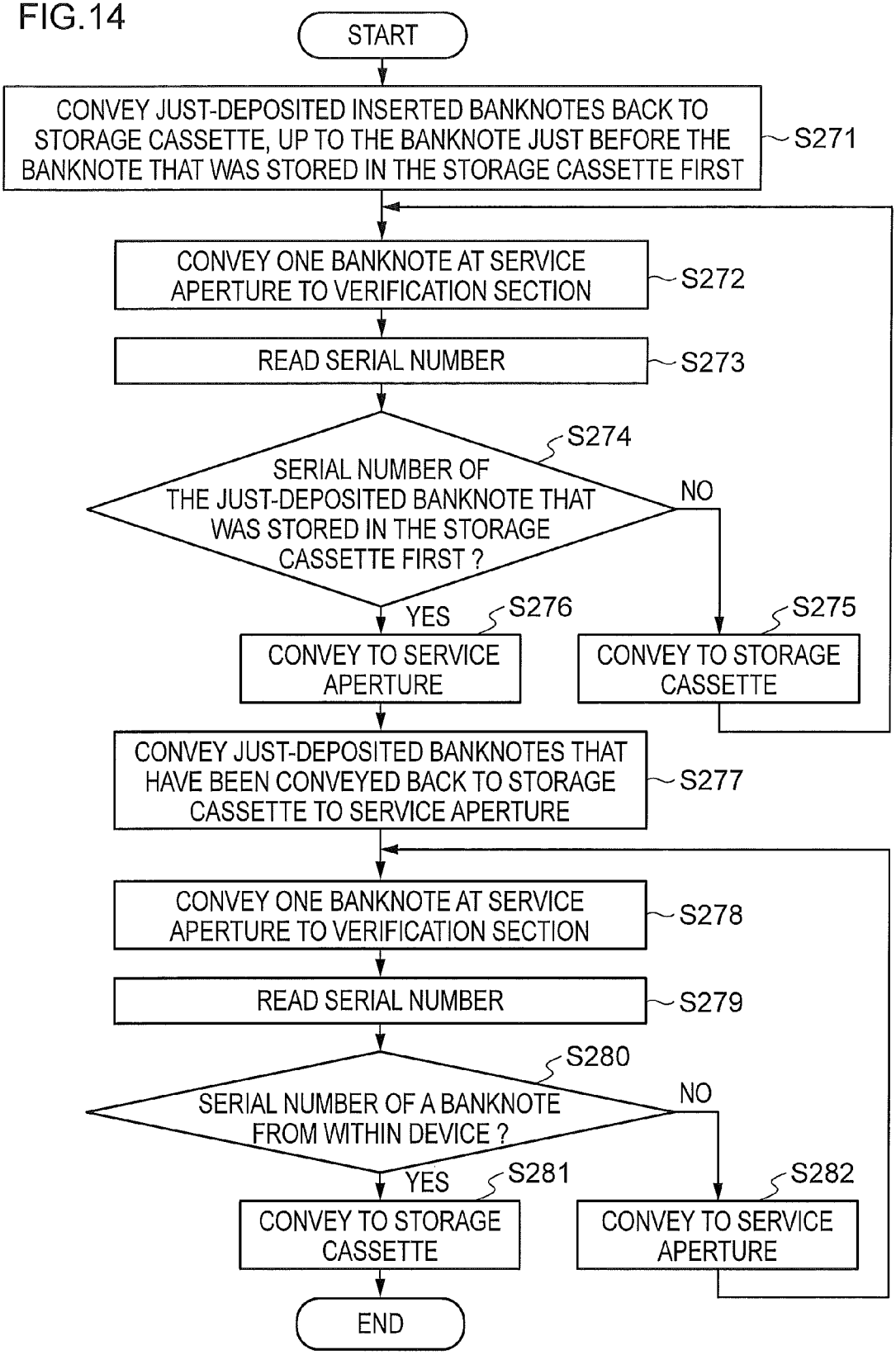
FIG. 14 is a flowchart illustrating details of the processing in step S170 of FIG. 3, in a second banknote return process.

The second banknote return process by the banknote deposit and withdrawal device 100 according to the present exemplary embodiment is described on the basis of FIG. 3 and FIG. 14 to FIG. 23. FIG. 14 is a flowchart illustrating details of the processing in step S170 of FIG. 3, in the second banknote return process. FIG. 15 to FIG. 23 are descriptive diagrams describing the second banknote return process of the banknote deposit and withdrawal device 100 in accordance with the present exemplary embodiment. The second banknote return process is also carried out in line with the flowchart of FIG. 3, but the processing in step S170 differs from the processing in the first banknote return process. Hereinbelow, mainly the processing of step S170 that differs from the first banknote return process is described. Processing that is the same as in the first banknote return process is only briefly described. The configuration of the banknote deposit and withdrawal device 100 illustrated in FIG. 15 to FIG. 23 is the same as the configuration of the device illustrated in FIG. 6 to FIG. 13.

2-2-1. Banknote Return Processing

Figure 15:
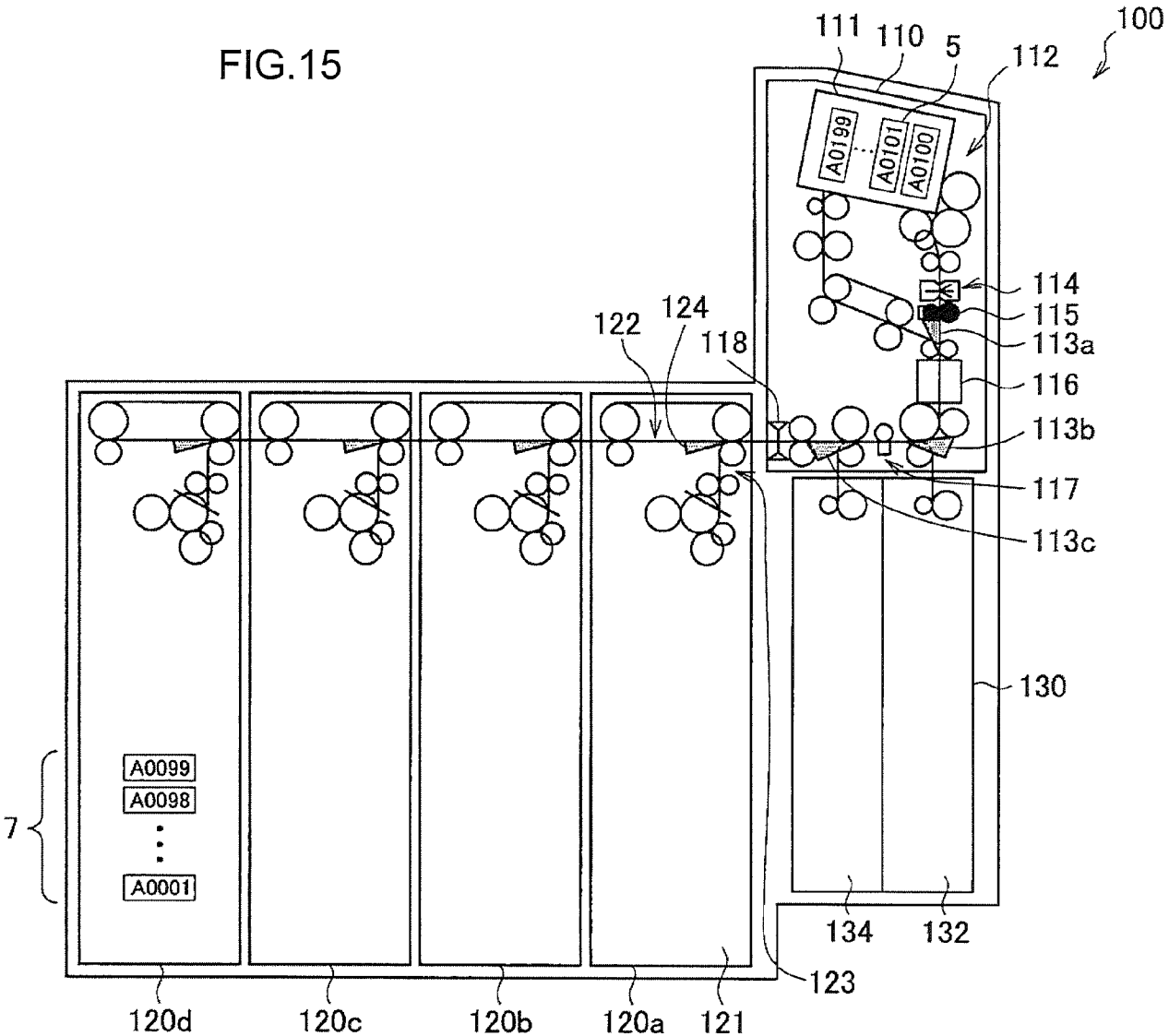
FIG. 15 is a diagram describing the second banknote return process of the banknote deposit and withdrawal device in accordance with the present exemplary embodiment.

First, as illustrated in FIG. 3, the banknotes 5 are inserted into the service aperture 111 of the banknote deposit and withdrawal device 100 (S100). For example, as illustrated in FIG. 15, the inserted banknotes 6 with the serial numbers A0100, A0101, . . . , A0199, which are to be stored in the storage cassette 120*d*, are inserted into the service aperture 111 of the banknote deposit and withdrawal device 100. At this time, the banknotes from within the device 7 with the serial numbers A0001, . . . , A0098, A0099 have already been stored in the storage cassette 120*d*.

Each inserted banknote 6 inserted into the service aperture 111 is conveyed along the conveyance path 112 and is verified by the transmission-type image sensor 114, the thickness sensor 115, the reflection-type image sensor 116 and the magnetic sensor 117 in the service unit 110 provided on the conveyance path, and the serial number of each inserted banknote 6 being conveyed is read (S110). The control section 60 of the banknote deposit and withdrawal device 100 controls driving of the conveyance section 50, on the basis of the verification results from the verification section 20, so as to convey each banknote 5 to the storage cassette 120 storing the denomination of the inserted banknote 6 that is being conveyed, and stores the inserted banknote 6 in the storage cassette 120 (S120). For example, in the case illustrated in FIG. 15 in which the inserted banknotes 6 with the serial numbers A0100, A0101, . . . , A0199 are to be stored in the storage cassette 120*d*, the control section 60 controls driving of the conveyance section 50 so as to store the inserted banknotes 6 with the serial numbers A0100, A0101, . . . , A0199 in the storage cassette 120*d*. Thus, as illustrated in FIG. 16, the inserted banknotes 6 with the serial numbers A0100, A0101, . . . , A0199 are stored in the storage cassette 120*d*.

The banknote deposit and withdrawal device 100 memorizes, in the memory section 80, the serial number of each inserted banknote 6 read in step S110 together with the stacking sequence of the inserted banknote 6 in the storage destination (S130). For example, when the inserted banknotes 6 with the serial numbers A0100, A0101, . . . , A0199 are stored in the storage cassette 120*d* as illustrated in FIG. 16, the banknote deposit and withdrawal device 100 records the serial numbers A0100, A0101, . . . , A0199 of the inserted banknotes 6 in the memory section 80 subsequent to the serial numbers A0001, . . . , A0098, A0099 of the banknotes from within the device 7 as administration information (banknote serial numbers and storage sequences) for the storage cassette 120*d*. At this stage, until the inserted banknotes 6 are actually deposited, the serial number A0099 of the banknotes from within the device 7 that is disposed in the topmost position (that is, was stored most recently) among the banknotes from within the device 7 previously stored in the storage cassette 120*d* and the serial numbers A0100, A0101, . . . , A0199 of the inserted banknotes 6 are memorized as different sets of administration information. Therefore, the control section 60 may monitor a boundary between the inserted banknotes 6 and the banknotes from within the device 7 that are stacked in the storage cassette 120*d*.

Then, the control section 60 of the banknote deposit and withdrawal device 100 makes the determination as to whether there is a return request for the inserted banknotes 6, before the transaction is confirmed (S140). In a case in which there is a return request for the banknotes 5 before the deposit transaction is confirmed, the banknote return processing is executed (S150).

Figure 16:
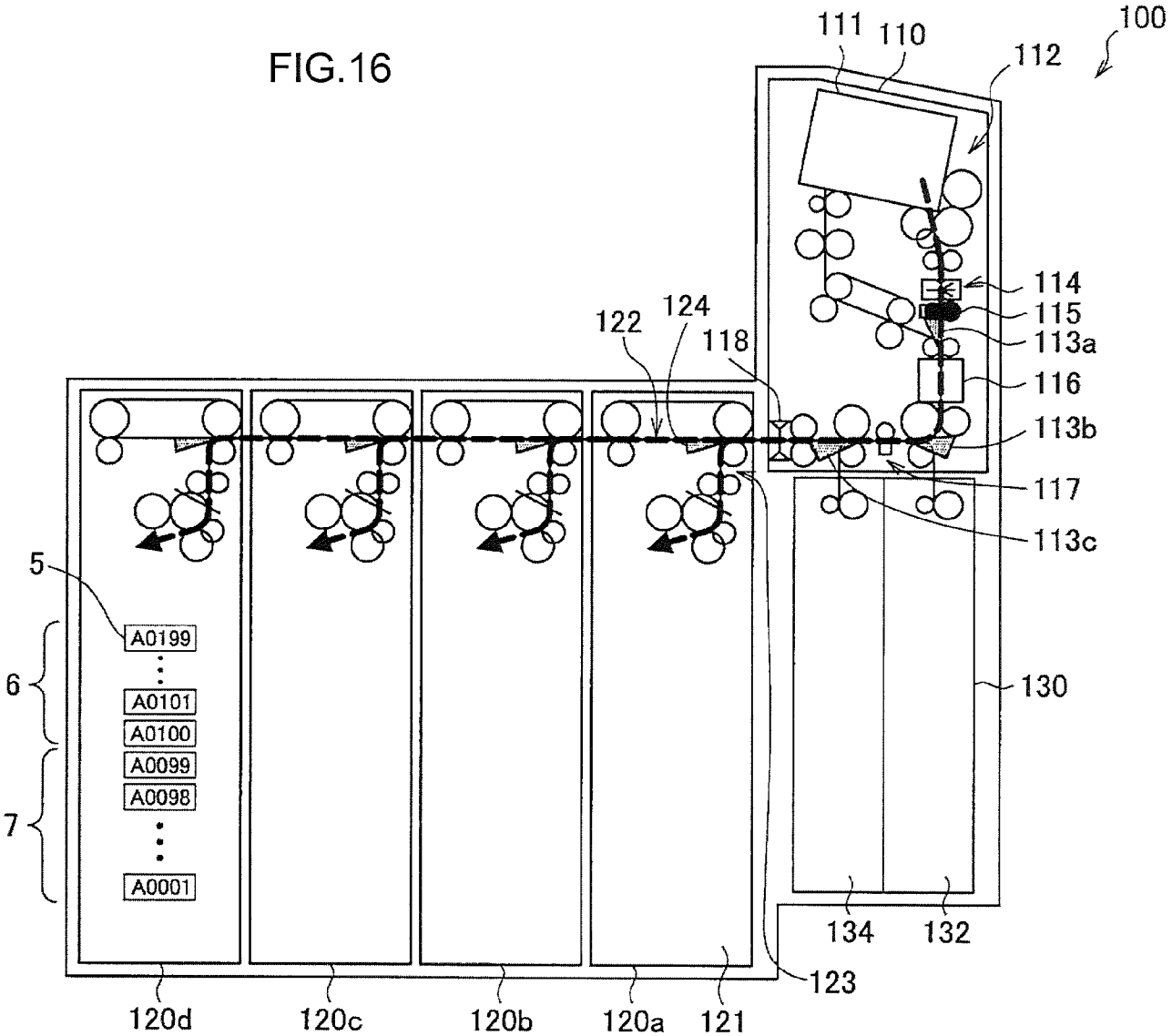
FIG. 16 is a diagram describing the second banknote return process of the banknote deposit and withdrawal device in accordance with the present exemplary embodiment.

For example, in a case in which the just-deposited inserted banknotes 6 have been stored in the storage cassette 120*d* as in FIG. 16, in order to convey the inserted banknotes 6 from the storage cassette 120*d* to the service aperture 111 of the service unit 110, the control section 60 first causes the inserted banknotes 6 with the serial numbers A0100, A0101, . . . , A0199 to be fed out from the storage cassette 120*d*, and then the inserted banknotes 6 are conveyed through the first conveyance paths 122 of the storage cassettes 120*c* to 120*a* to the service unit 110.

Thicknesses of the inserted banknotes 6 conveyed to the service unit 110 are detected by the thickness sensor 118 and the serial numbers of the inserted banknotes 6 conveyed from the storage cassette 120*d* to the service aperture 111 are read by the verification section 20. The control section 60 uses at least one of these sets of information to determine whether or not a banknote from within the device 7 that was previously stored in the device has been mistakenly conveyed to the service aperture 111 together with the inserted banknotes 6 (S160).

Figure 17:
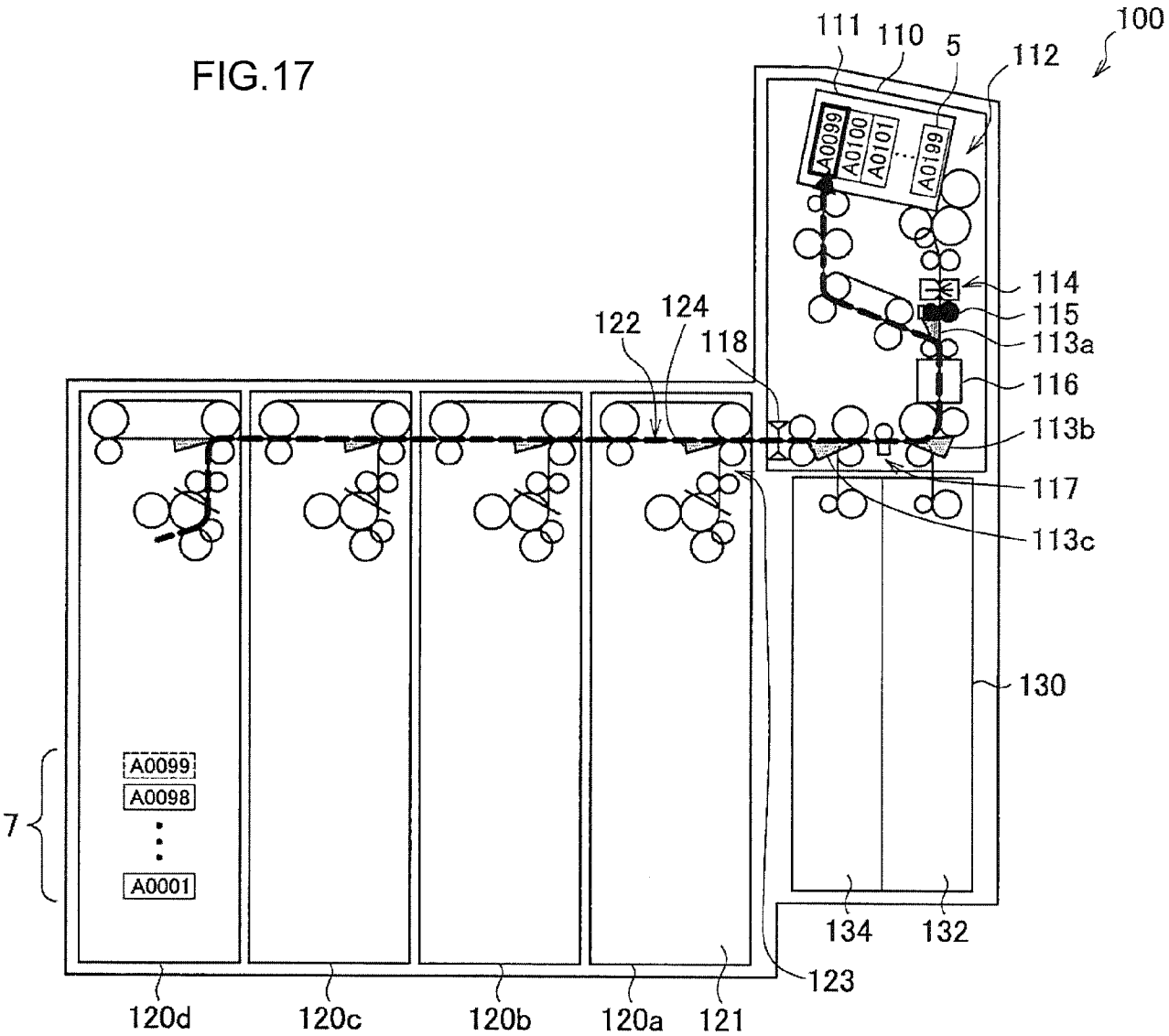
FIG. 17 is a diagram describing the second banknote return process of the banknote deposit and withdrawal device in accordance with the present exemplary embodiment.

In a case in which it is determined in step 160 that any of the banknotes from within the device 7 that should be left stored in the storage cassette 120*d* has been brought out, the control section 60 performs processing (S170) to separate the banknote from within the device 7 that has been brought out from the inserted banknotes 6 that have just been deposited and should be returned, and to store the banknote from within the device 7 back in the storage cassette 120*d* (S170). For example, as illustrated in FIG. 17, the banknote from within the device 7 with the serial number A0099 has been brought out. The banknote from within the device 7 with the serial number A0099 was adjacent to the inserted banknote 6 with the serial number A0100, which was the first of the just-deposited inserted banknotes 6 to be stored in the storage cassette 120*d*. The banknote from within the device 7 with the serial number A0099 is not one of the inserted banknotes 6 that should be returned to the customer. Therefore, by the processing of step S170, the banknote from within the device 7 with the serial number A0099 is conveyed to and stored in the storage cassette 120*d* in which it was originally stored.

Figure 18:
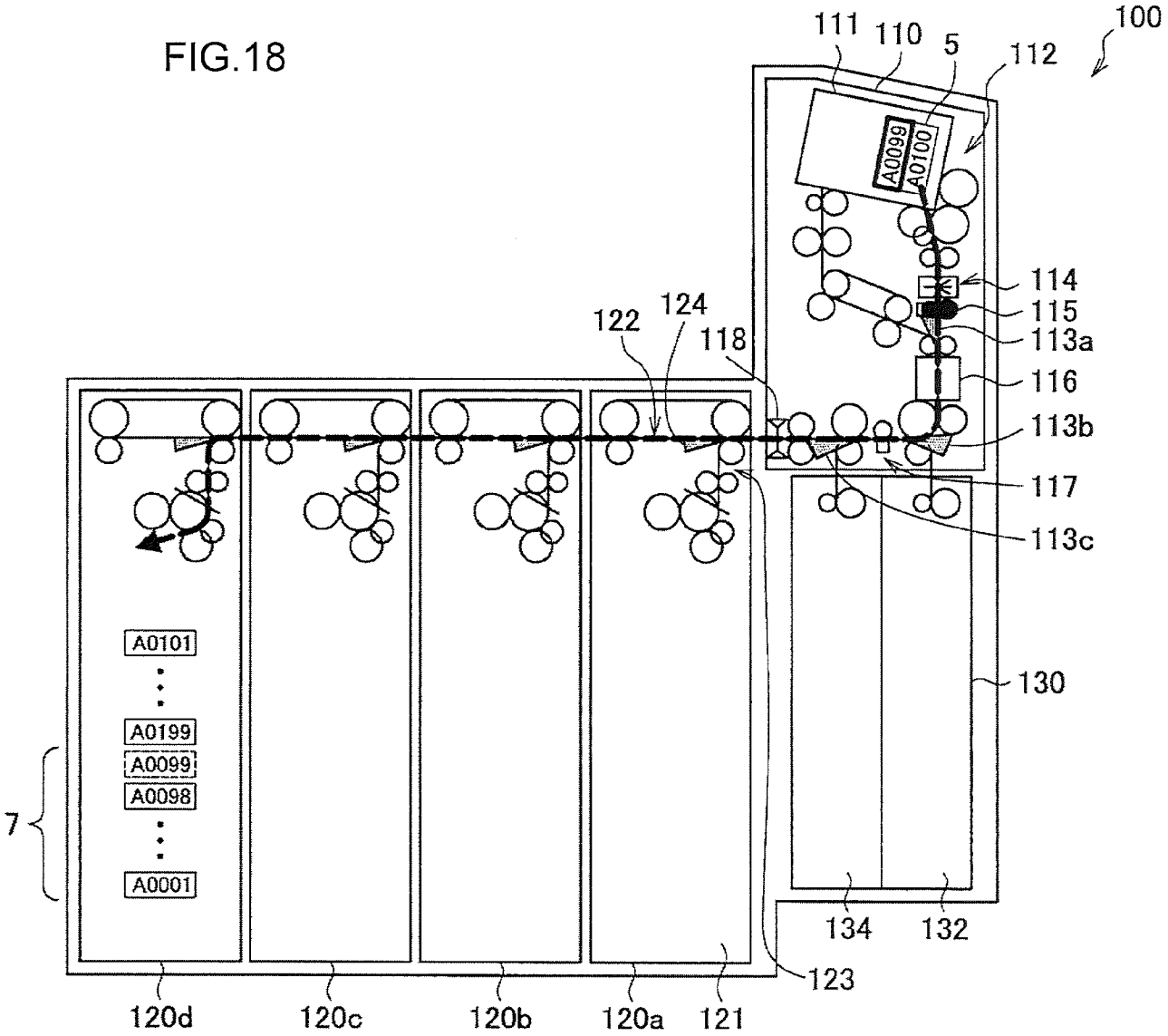
FIG. 18 is a diagram describing the second banknote return process of the banknote deposit and withdrawal device in accordance with the present exemplary embodiment.

For the processing to separate the banknote from within the device 7 that has been brought out, as illustrated in FIG. 14, first, the banknotes 5 at the service aperture 111 are conveyed back to the storage cassettes 120 up to the inserted banknote 6 just before the inserted banknote 6 that was stored in the storage cassette 120 first (S271). For example, of the banknotes 5 in the service aperture 111 illustrated in FIG. 17, the control section 60 feeds the inserted banknotes 6 at the banknote feed-out aperture side of the service aperture 111 out from the banknote feed-out aperture and conveys the same to the storage cassette 120, up until the inserted banknote 6 with the serial number A0101 just before the inserted banknote 6 with the serial number A0100 that was stored in the storage cassette 120 first. That is, as illustrated in FIG. 18, the inserted banknotes 6 with the serial numbers A0199, . . . , A0101 are conveyed to and stored in the storage cassette 120*d*. When these inserted banknotes 6 are being conveyed, the control section 60 reads their serial numbers with the verification section 20, refers to the administration information and checks that they are the inserted banknotes 6, and checks that the inserted banknotes 6 are conveyed to the storage cassette 120*d* up until serial number A0101. Consequent to the processing of step S271, two of the banknotes 5 (that is, the inserted banknote 6 with the serial number A0100 and the banknote from within the device 7 with the serial number A0099) are left at the service aperture 111.

Then, the control section 60 conveys one banknote 5 at the banknote feed-out aperture side of the service aperture 111 to the verification section 20 (S272). In the example illustrated in FIG. 19, the inserted banknote 6 with the serial number A0100 is conveyed to the verification section 20. The serial number of the inserted banknote 6 conveyed to the verification section 20 is read (S273), and the control section 60 makes a determination as to whether the serial number of the inserted banknote 6 read in step S273 is the serial number of the banknote 5 that was the first of the just-deposited inserted banknotes 6 to be stored in the storage cassette 120 (S274). The control section 60 refers to the serial numbers and storage sequences or the like of the banknotes in the administration information memorized in the memory section 80, and determines whether or not the serial number of the inserted banknote 6 read in step S273 matches the serial number of the inserted banknote 6 that was the first of the just-deposited inserted banknotes 6 to be stored in the storage cassette 120.

In step S274, in a case in which the serial number of the inserted banknote 6 read in step S273 does not match the serial number of the banknote 5 that was the first of the just-deposited inserted banknotes 6 to be stored in the storage cassette 120, this inserted banknote 6 is conveyed to the storage cassette 120 in which the inserted banknotes 6 have been stored (step S275). That is, because this is not the banknote 5 that was the first of the just-deposited inserted banknotes 6 to be stored in the storage cassette 120, the processing continues with step S271 and the inserted banknote 6 is conveyed to the storage cassette 120. Hence, the processing from step S272 is repeated. On the other hand, in step S274, in a case in which the serial number of the inserted banknote 6 read in step S273 matches the serial number (administration information) of the inserted banknote 6 that was the first of the just-deposited inserted banknotes 6 to be stored in the storage cassette 120, this inserted banknote 6 is conveyed to the service aperture 111 (step S276).

Figure 19:
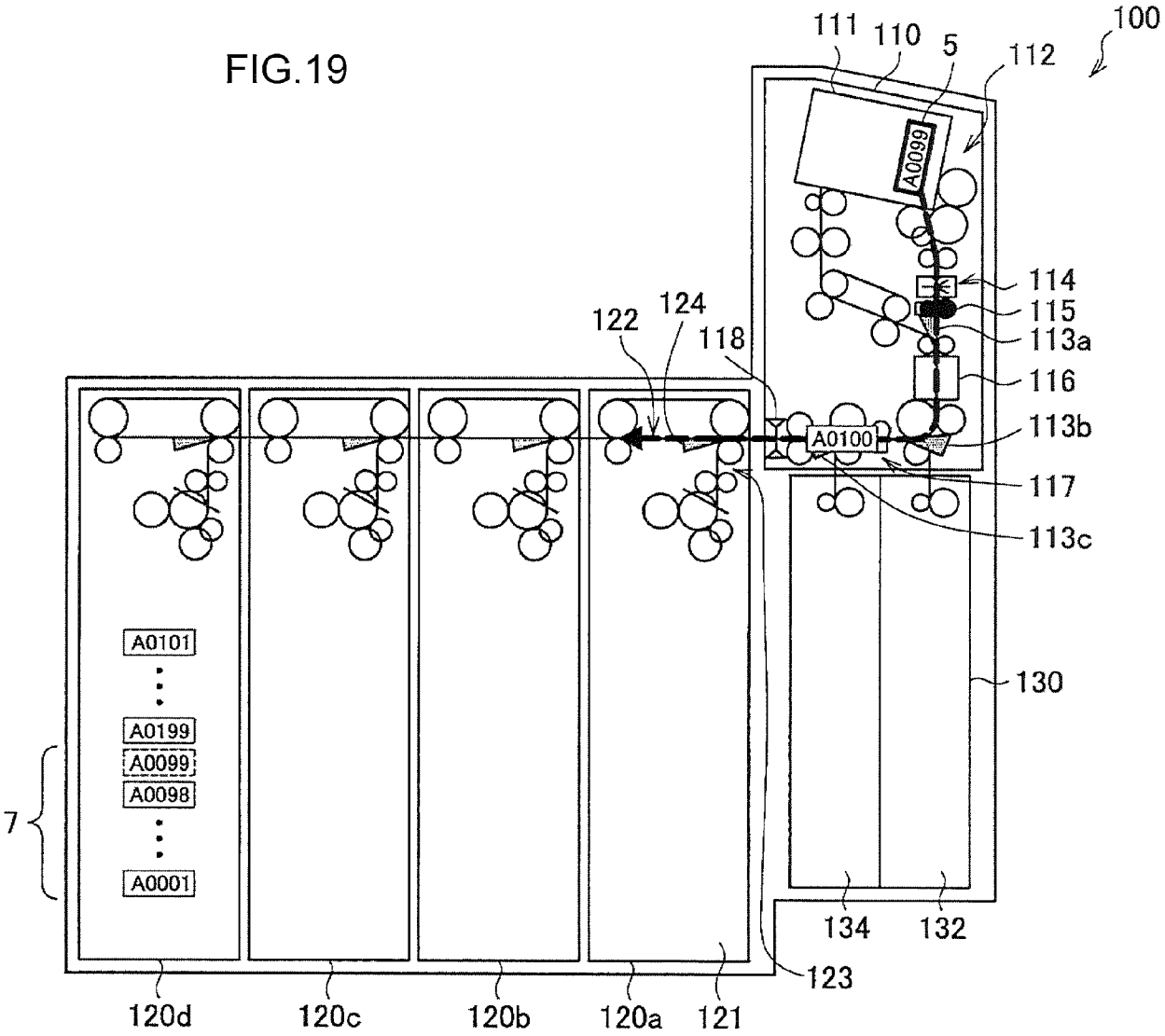
FIG. 19 is a diagram describing the second banknote return process of the banknote deposit and withdrawal device in accordance with the present exemplary embodiment.
Figure 20:
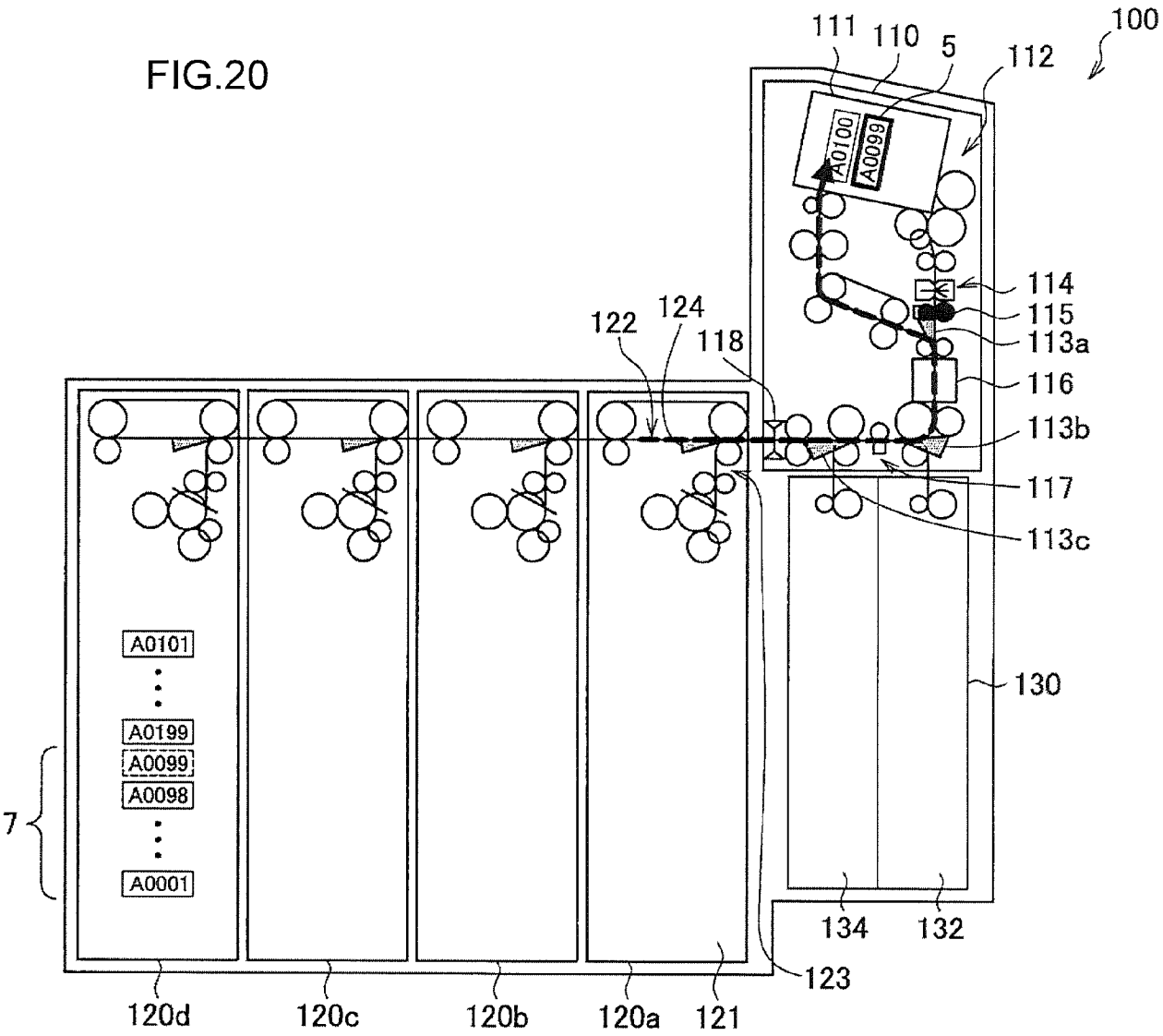
FIG. 20 is a diagram describing the second banknote return process of the banknote deposit and withdrawal device in accordance with the present exemplary embodiment.

In the example illustrated in FIG. 19, the inserted banknote 6 with the serial number A0100 is the inserted banknote 6 that was the first of the inserted banknotes 6 to be stored in the storage cassette 120. Therefore, the control section 60 switchbacks the inserted banknote 6 with the serial number A0100 that has been conveyed to the thickness sensor 118 and feeds it along the conveyance path 112 of the service aperture 111 and through the banknote feed-in aperture to the service aperture 111. Thus, inside the service aperture 111, the banknote from within the device 7 with the serial number A0099 and the inserted banknote 6 with the serial number A0100 are stored in this order from the banknote feed-out aperture side. That is, the brought-out banknote from within the device 7 with the serial number A0099 is disposed at the banknote feed-out aperture side of the service aperture 111.

Figure 21:
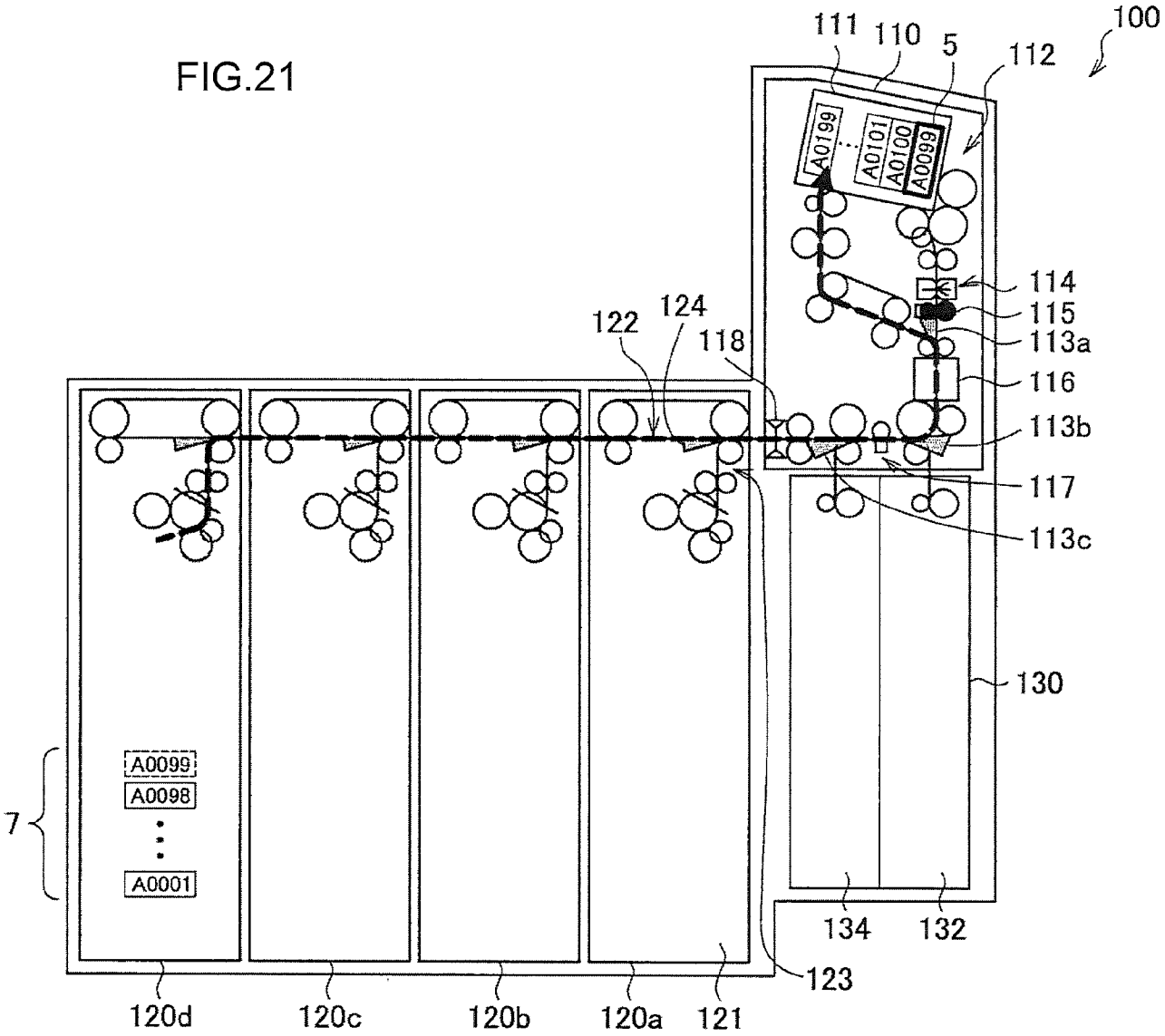
FIG. 21 is a diagram describing the second banknote return process of the banknote deposit and withdrawal device in accordance with the present exemplary embodiment.

Then, the control section 60 conveys the inserted banknotes 6 that have been conveyed back to the storage cassette 120 to the service aperture 111 again (S277). Thus, as illustrated in FIG. 21, the inserted banknotes 6 are withdrawn from the storage cassette 120 and conveyed to the service aperture 111, so that the banknote from within the device 7 with the serial number A0099 and the inserted banknotes 6 with the serial numbers A0100, A0101, . . . , A0199 are stored next to one another in this order from the banknote feed-out aperture side.

Then, the control section 60 conveys one banknote 5 at the banknote feed-out aperture side of the service aperture 111 to the verification section 20 (S278). In the example illustrated in FIG. 22, the banknote from within the device 7 with the serial number A0099 is conveyed to the verification section 20. The serial number of the banknote from within the device 7 that has been conveyed to the verification section 20 is read (S279), and the control section 60 makes a determination (S280) as to whether the serial number of the banknote from within the device 7 read in step S279 is a serial number of the banknotes from within the device 7 previously stored in the storage cassette 120. Here, the control section 60 refers to the serial numbers and storage sequences or the like of the banknotes in the administration information memorized in the memory section 80, and determines whether or not the serial number of the banknote from within the device 7 read in step S279 matches the serial number of any of the banknotes from within the device 7 that were already stored in the storage cassette 120.

If, in step S280, the serial number acquired in step S279 matches the serial number (administration information) of a banknote from within the device 7 previously stored in the storage cassette 120, this banknote is a banknote from within the device 7 that has been brought out. Therefore, the banknote from within the device 7 is conveyed to the storage cassette 120 in which it was originally stored (S281) and the processing illustrated in FIG. 14 ends. On the other hand, in step S280, in a case in which the serial number acquired in step S279 does not match the serial number (administration information) of any of the banknotes from within the device 7 that were already stored in the storage cassette 120, the processing is repeated from step S278.

Figure 22:
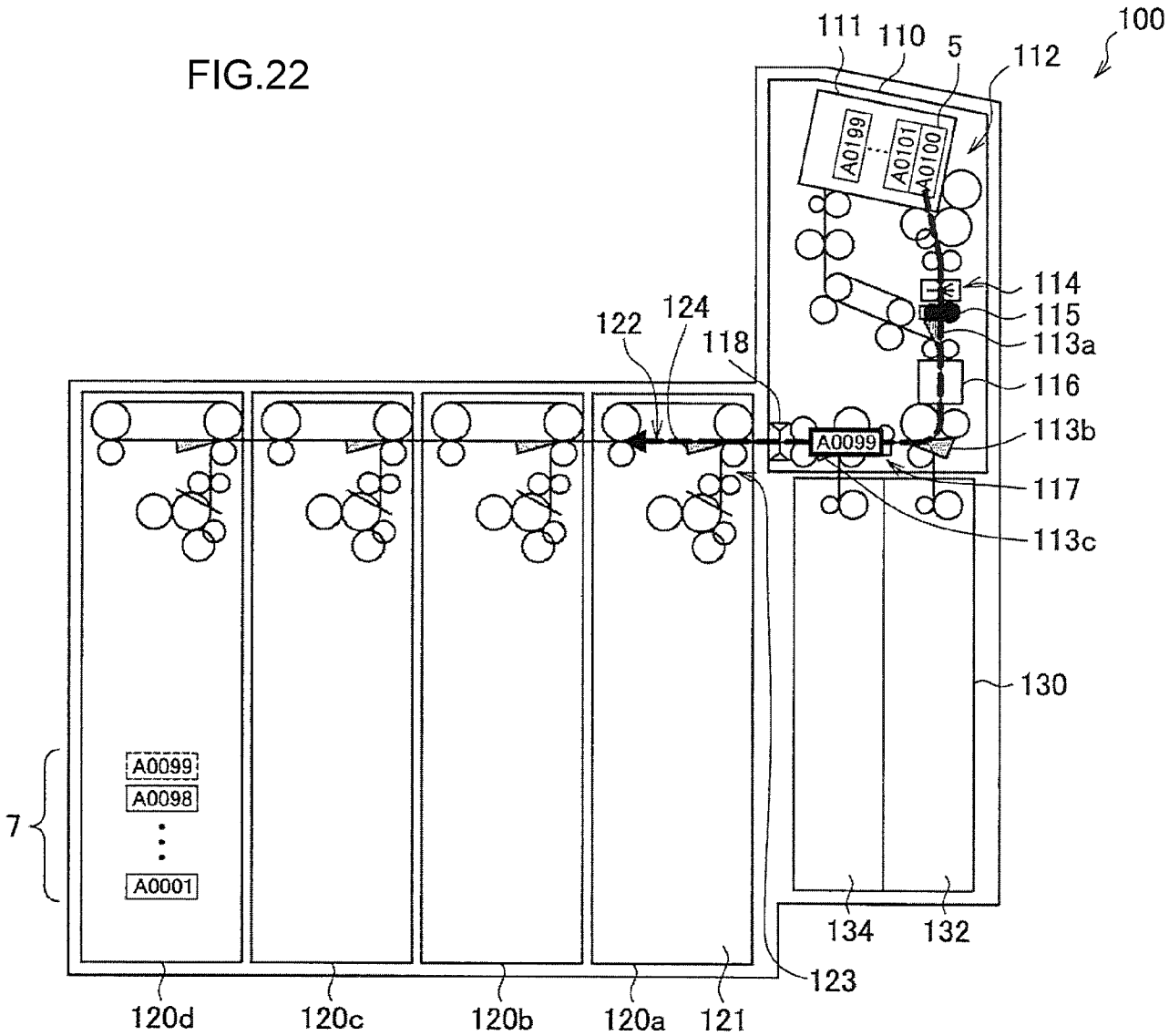
FIG. 22 is a diagram describing the second banknote return process of the banknote deposit and withdrawal device in accordance with the present exemplary embodiment.
Figure 23:
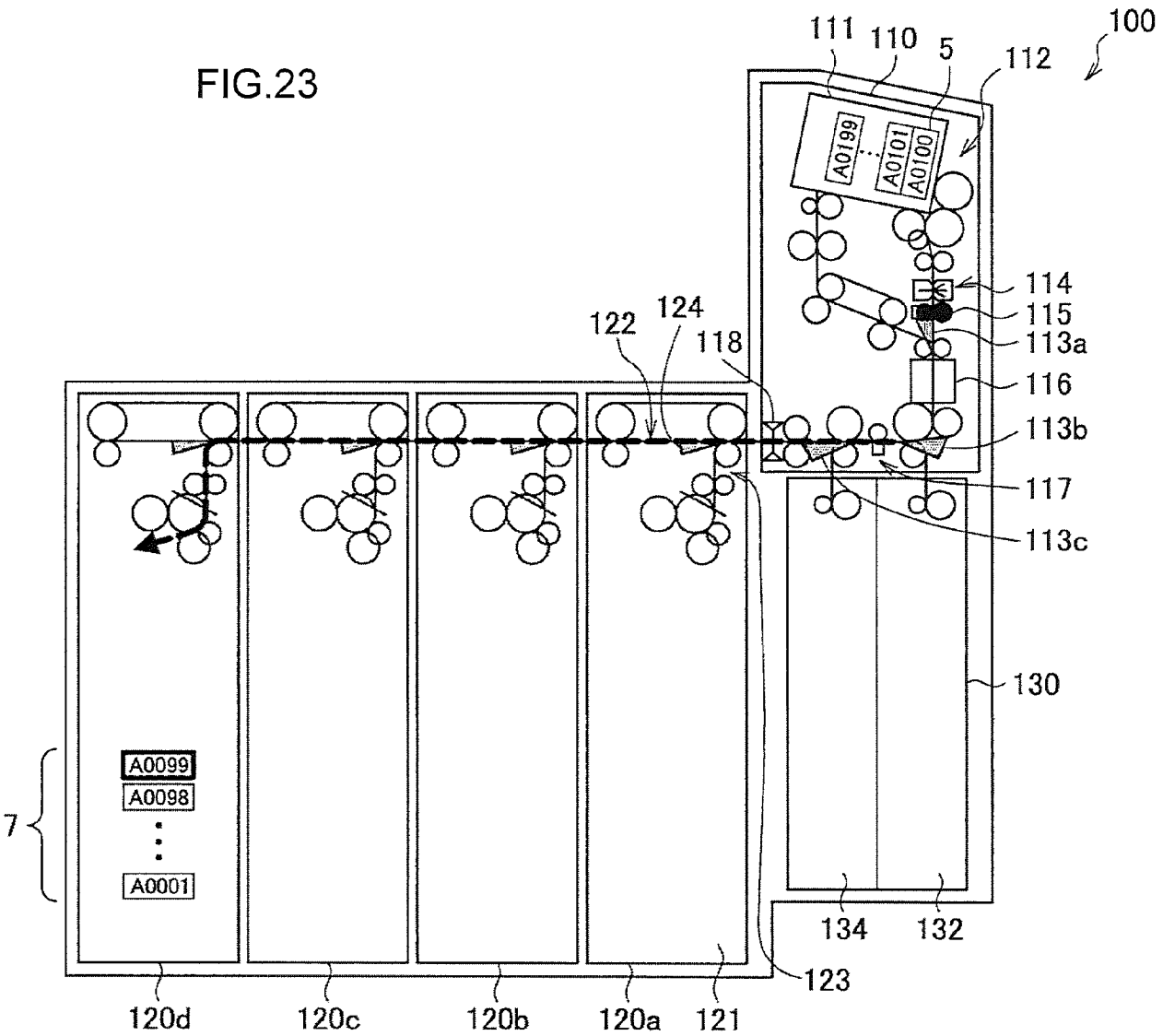
FIG. 23 is a diagram describing the second banknote return process of the banknote deposit and withdrawal device in accordance with the present exemplary embodiment.

For example, as illustrated in FIG. 22, the banknote from within the device 7 with the serial number A0099 that is at the banknote feed-out aperture side of the service aperture 111 is fed out and conveyed to the conveyance path 112. When the serial number is read at the verification section 20, the processing for matching with the serial numbers administered in the administration information is carried out. Because the banknote from within the device 7 with the serial number A0099 is a banknote from within the device 7 that was already stored in the storage cassette 120*d*, as illustrated in FIG. 23, the control section 60 stores the banknote from within the device 7 with the serial number A0099 into the storage cassette 120*d*, via the first conveyance paths 122 of the storage cassettes 120*a* to 120*d*. Thus, the banknotes from within the device 7 that have been brought out may be conveyed to the storage cassettes 120 in accordance with the banknote serial numbers and the storage sequences of the banknotes in the storage cassettes 120. In this case, every brought-out banknote from within the device 7 is returned to the storage cassette 120*d*.

Returning now to the description of FIG. 3, when all banknotes from within the device 7 that have been brought out have been returned to the storage cassettes 120 in step S170, the serial numbers and storage sequences of the banknotes from within the device 7 that have just been stored in the storage cassettes 120 are confirmed (S180). Accordingly, the administration information in the memory section 80 is updated. In a case in which the banknotes 5 that were just deposited have been returned to the customer by the processing of steps S150 to S170, the administration information is confirmed as being in the state prior to the current deposit transaction. On the other hand, in a case in which there is no return request for the banknotes 5 in step S140 or it is determined that no banknote has been brought out in step S160, the administration information is updated by step S180 to information that includes the inserted banknotes 6 that have just been deposited on the banknotes from within the device 7. Thus, the banknotes from within the device 7 currently stored in the storage cassettes 120 may be accurately monitored.

The second banknote return process has been described hereabove. The banknote deposit and withdrawal device 100 according to the present exemplary embodiment memorizes the serial numbers and storage sequences of the banknotes from within the device 7 stored in the storage cassettes 120 as attribute information in the memory section 80 at times of deposit transactions of the banknotes 5. Until a transaction is completed, the inserted banknotes 6 that are currently being deposited and the banknotes from within the device 7 that were already stored in the storage cassettes 120 are differentiated. In the second banknote return process, when a return request for the inserted banknotes 6 is received and the inserted banknotes 6 that have been stored in the storage cassettes 120 are conveyed to the service aperture 111, in a case in which it is detected by the thickness sensor 118 that a banknote from within the device 7 that is not an object of return has been brought out together with the just-deposited inserted banknotes 6, the control section 60 returns the brought-out banknotes from within the device 7 to the storage cassettes 120 in which they were originally stored, and keeps only the just-deposited inserted banknotes 6 in the service aperture 111.

To this end, the control section 60 first conveys the just-deposited inserted banknotes 6 back to each storage cassette 120, up to the inserted banknote 6 just before the inserted banknote 6 that was the first of the inserted banknotes 6 to be stored in the storage cassette 120. Then, of the banknotes 5 remaining in the service aperture 111, the control section 60 disposes each banknote from within the device 7 brought out from the storage cassette 120 at the banknote feed-out aperture side of the service aperture 111, and then conveys the just-deposited inserted banknotes 6 that have been conveyed back to the storage cassettes 120 to the service aperture 111 again. Thereafter, the control section 60 returns each banknote from within the device 7 brought out from the storage cassettes 120, which is disposed at the banknote feed-out aperture side of the service aperture 111, to the storage cassettes 120.

Thus, there is no need for all the banknotes from within the device 7 in the storage cassettes 120 to be re-verified and only the inserted banknotes 6 inserted for the current deposit transaction are re-verified. Therefore, the banknotes deposited by the customer may be identified in a short time. In particular, in the second banknote return process, a portion of the inserted banknotes 6 that have just been deposited may collectively be temporarily withdrawn, and there is no need to perform processing to verify and convey the banknotes from within the device 7 at the service aperture 111 one at a time as in the first banknote return process. Therefore, because the processing duration may be made shorter than with the first banknote return process, use of the second banknote return process is more effective when the number of inserted banknotes 6 that are objects of return is larger.

2-3. Use of the Banknote Return Processes

As mentioned above, the first banknote return process and the second banknote return process may be used both when there is a request for return of the inserted banknotes 6 from the customer and when a fault such as a jam or the like occurs during a deposit transaction. In a case in which it is possible for the device to perform re-verification after a fault has occurred, just the inserted banknotes 6 that have been stacked in the storage cassettes 120 by the current deposit transaction are fed out and returned to the customer. At this time, even in a case in which a banknote from within the device 7 that is not an object of return is brought out due to multiple feeding or the like, just the inserted banknotes 6 that are objects of return may be returned, by use of the first banknote return process or second banknote return process described above. The meaning of the term "it is possible for the device to perform re-verification" as used herein is intended to include a state in which, in a case in which the device has stopped due to a fault, reject processing that returns any banknotes 5 that were being conveyed back to the service aperture 111 in an automatic recovery operation is possible and operation of the device may be continued.

In a case in which re-verification is not possible, that is, in a case in which the device cannot be automatically recovered and conveyance of the banknotes 5 is not possible, the serial numbers of the inserted banknotes 6 stacked by the current deposit transaction and the storage cassettes 120 in which they are stored are reported to an operator. Therefore, the operator may assuredly identify which inserted banknotes 6 were inserted by the customer and may return these inserted banknotes 6. In this case, a reporting section is provided at the banknote deposit and withdrawal device 100 for the banknote deposit and withdrawal device 100 to report the serial numbers of the inserted banknotes 6 stacked by the current deposit transaction and the storage cassettes 120 in which they are stored to the operator. For example, a display section that displays information, a voice output section that outputs voice information, or the like may be used as the reporting section.

Because, as in the banknote deposit and withdrawal device 100 according to the present exemplary embodiment, the serial numbers of the banknotes are acquired by the verification section 20 and the serial numbers of the deposited inserted banknotes 6 and storage sequences in the storage destinations are memorized in the memory section 80 as administration information, states of the inserted banknotes 6 within the device may be monitored. Therefore, for example, even in a case in which functioning of the device goes down because of a power cut or the like, after functioning of the device recovers, the serial numbers of banknotes 5 that are in the conveyance path may be read by the image sensor of the verification section 20 and the presence of any inserted banknotes 6 that have been left unclaimed in the service aperture 111 may be identified.

3. Variant Examples of the Banknote Deposit and Withdrawal Device

The first banknote return process and second banknote return process according to the present exemplary embodiment may be employed in, for example, banknote deposit and withdrawal devices other than the banknote deposit and withdrawal device 100 illustrated in FIG. 5 and the like. Other structural examples of the banknote deposit and withdrawal device are illustrated in FIG. 24 to FIG. 27. Hereinbelow, mainly differences from the banknote deposit and withdrawal device 100 described above are described. Structural parts that are the same are not described in detail.

3-1. Example 1

Figure 24:
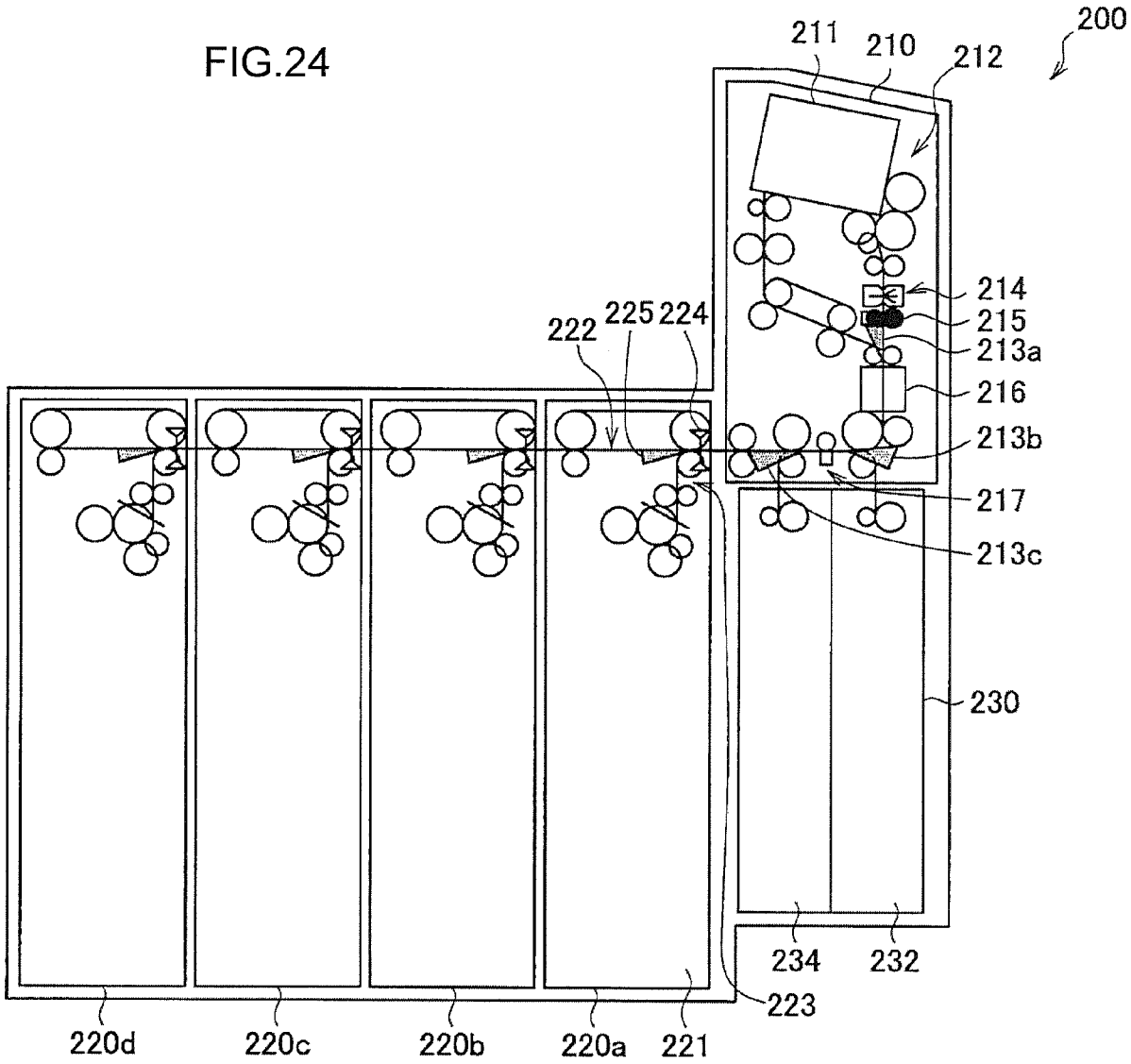
FIG. 24 is a descriptive diagram illustrating another example of the banknote deposit and withdrawal device.

First, a banknote deposit and withdrawal device 200 that is illustrated in FIG. 24 differs from the banknote deposit and withdrawal device 100 illustrated in FIG. 5 and the like in that, instead of the single thickness sensor 118 provided in the service unit 110, respective thickness sensors 224 are provided in storage cassettes 220*a* to 220*d*. That is, as illustrated in FIG. 24, the banknote deposit and withdrawal device 200 is constituted with a service unit 210, the storage cassettes 220 (220*a* to 220*d*) and a reject holding unit 230.

The service unit 210 is a unit that transfers banknotes to and from a user. As illustrated in FIG. 24, the service unit 210 includes a service aperture 211, which includes a feeding mechanism that feeds out deposited banknotes and a stacking mechanism that stacks withdrawn banknotes. A conveyance path 212 connects the service aperture 211 with the storage cassettes 220 and the reject holding unit 230. On the path of the conveyance path 212, switching mechanisms 213*a*, 213*b* and 213*c*, a transmission-type image sensor 214, a thickness sensor 215, a reflection-type image sensor 216 and a magnetic sensor 217 are provided. The switching mechanisms 213*a*, 213*b* and 213*c* are for switching between conveyance destinations of the banknotes. The sensors are for identifying denominations of banknotes, whether the banknotes are genuine or counterfeit, thicknesses and so forth. The transmission-type image sensor 214, thickness sensor 215, reflection-type image sensor 216 and magnetic sensor 217 are collectively referred to as the verification section 20. The service unit 210 functions in the same manner as the service unit 110 of the banknote deposit and withdrawal device 100, apart from the functioning of the thickness sensor 118.

Each storage cassette 220 is equipped with a storage section 221, a first conveyance path 222 and a second conveyance path 223. The storage section 221 stores banknotes. The first conveyance path 222 transfers banknotes two ways between the service unit 210 or the preceding storage cassette 220 and the succeeding storage cassette 220 or the like. The second conveyance path 223 is provided with a feeding mechanism that feeds out banknotes from the storage section 221 and a stacking mechanism that stacks banknotes in the storage section 221. The storage cassette 220 is also equipped with the thickness sensor 224, which identifies thicknesses of deposited and withdrawn banknotes, and a switching mechanism 225 for switching between banknote conveyance destinations. The banknote deposit and withdrawal device 200 is provided in a state in which the four storage cassettes 220*a* to 220*d* are arrayed in a horizontal direction, and the storage cassettes 220*a* to 220*d* have matching configurations. Each thickness sensor 224 may have the same constitution as the thickness sensor 118 of the banknote deposit and withdrawal device 100.

The number of storage cassettes 220 provided in the banknote deposit and withdrawal device 200 is not limited to this example. The storage cassettes 220 may be provided in accordance with, for example, a number of kinds of banknote. Moreover, in one or more of the storage cassettes 220*a* to 220*d*, the switching mechanism 225 of that storage cassette 220 may be a switching mechanism that is capable of switching travel of the banknotes between three directions.

The reject holding unit 230 is equipped with a rejected media storage vault 232 and a forgotten media storage vault 234. The rejected media storage vault 232 stores banknotes identified as being multiply fed due to defective feeding during withdrawal processing. The forgotten media storage vault 234 stores banknotes left behind by users. Rejected banknotes and forgotten banknotes are stored in the reject holding unit 230 by switching by the switching mechanisms 213*b* and 213*c* of the service unit 210.

3-2. Example 2

Figure 25:
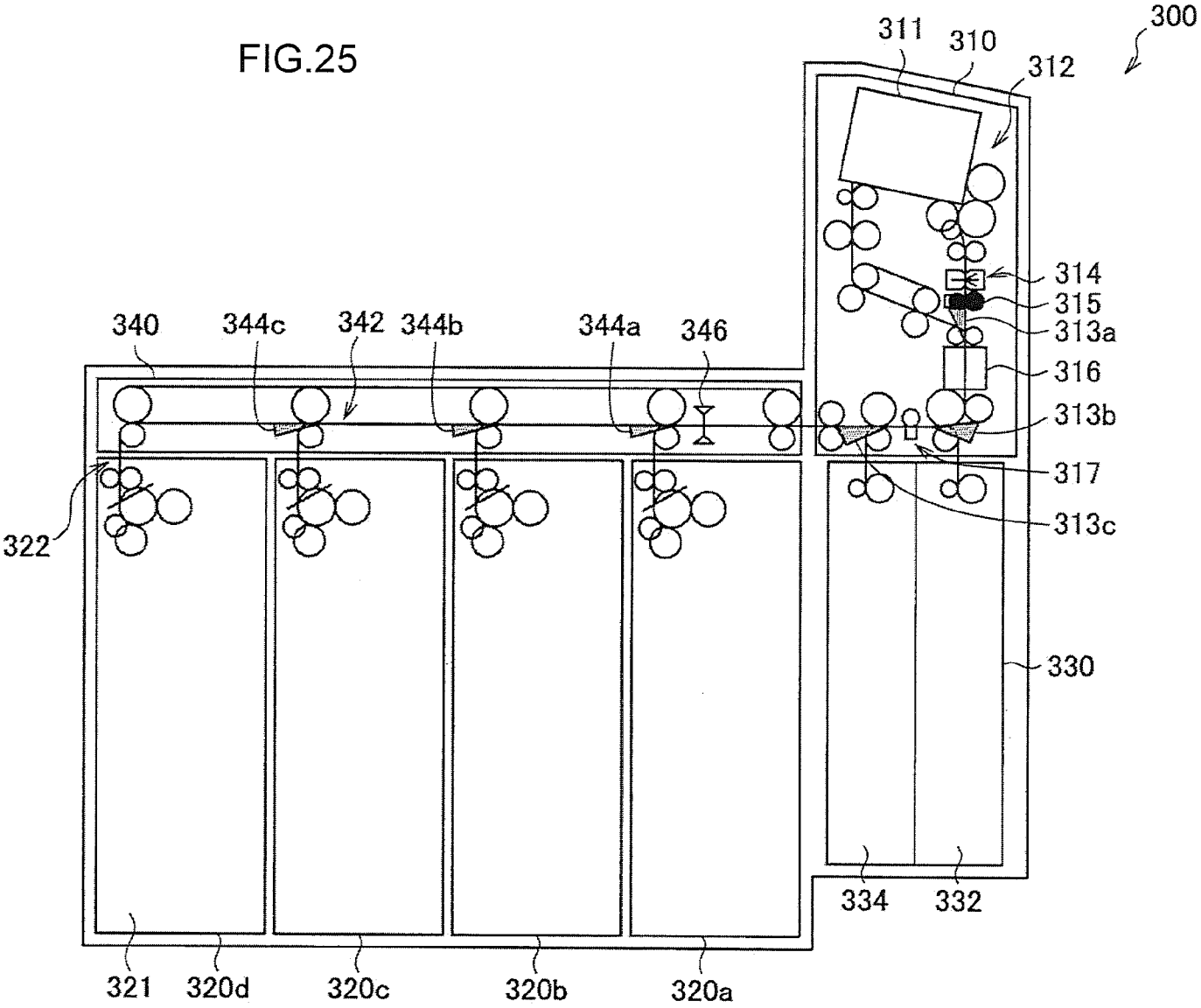
FIG. 25 is a descriptive diagram illustrating another example of the banknote deposit and withdrawal device.

Next, a banknote deposit and withdrawal device 300 that is illustrated in FIG. 25 differs from the banknote deposit and withdrawal device 200 illustrated in FIG. 24 in that the first conveyance paths 222, thickness sensors 224 and switching mechanisms 225 provided at the storage cassettes 220*a* to 220*d* are collected in a unit separate from the storage cassettes. As illustrated in FIG. 25, the banknote deposit and withdrawal device 300 is constituted with a service unit 310, storage cassettes 320 (320*a* to 320*d*), a reject holding unit 330 and a conveyance unit 340.

The service unit 310 is a unit that transfers banknotes to and from a user. The service unit 310 is provided with a service aperture 311 and a conveyance path 312. The service aperture 311 includes a feeding mechanism that feeds out deposited banknotes and a stacking mechanism that stacks withdrawn banknotes. The conveyance path 312 connects the service aperture 311 with the conveyance unit 340 and the reject holding unit 330. On the path of the conveyance path 312 of the service unit 310, switching mechanisms 313*a*, 313*b* and 313*c*, a transmission-type image sensor 314, a thickness sensor 315, a reflection-type image sensor 316 and a magnetic sensor 317 are provided. The sensors are for identifying denominations of banknotes, whether the banknotes are genuine or counterfeit, thicknesses and so forth.

Each storage cassette 320 is equipped with a storage section 321 and a conveyance path 322. The storage section 321 stores banknotes. The conveyance path 322 is provided with a feeding mechanism that feeds out banknotes from the storage section 321 and a stacking mechanism that stacks banknotes in the storage section 321. The banknote deposit and withdrawal device 300 is provided in a state in which the four storage cassettes 320*a* to 320*d* are arrayed in a horizontal direction, and the storage cassettes 320*a* to 320*d* have matching configurations. The number of storage cassettes 320 provided in the banknote deposit and withdrawal device 300 is not limited to this example. The storage cassettes 320 may be provided in accordance with, for example, a number of kinds of banknote.

The reject holding unit 330 is equipped with a rejected media storage vault 332 and a forgotten media storage vault 334. The rejected media storage vault 332 stores banknotes identified as being multiply fed due to defective feeding during withdrawal processing. The forgotten media storage vault 334 stores banknotes left behind by users. The reject holding unit 330 may have the same constitution as the reject holding unit 130 in FIG. 5 and the like.

The conveyance unit 340 connects the service unit 310 with the storage cassettes 320*a* to 320*d*, and includes a mechanism that conveys banknotes two ways. Specifically, as illustrated in FIG. 25, the conveyance unit 340 is constituted with a conveyance path 342, switching mechanisms 344*a*, 344*b* and 344*c*, and a thickness sensor 346. The conveyance path 342 feeds banknotes into the storage cassettes 320, and conveys banknotes fed out from the storage cassettes 320 to the service unit 310. The switching mechanisms 344*a*, 344*b* and 344*c* selectively switch the conveyance path 342 into the storage cassettes 320*a* to 320*d*. One or more of the switching mechanisms 344*a*, 344*b* and 344*c* of the conveyance unit 340 may be a switching mechanism that is capable of switching travel of the banknotes between three directions.

3-3. Example 3

Figure 26:
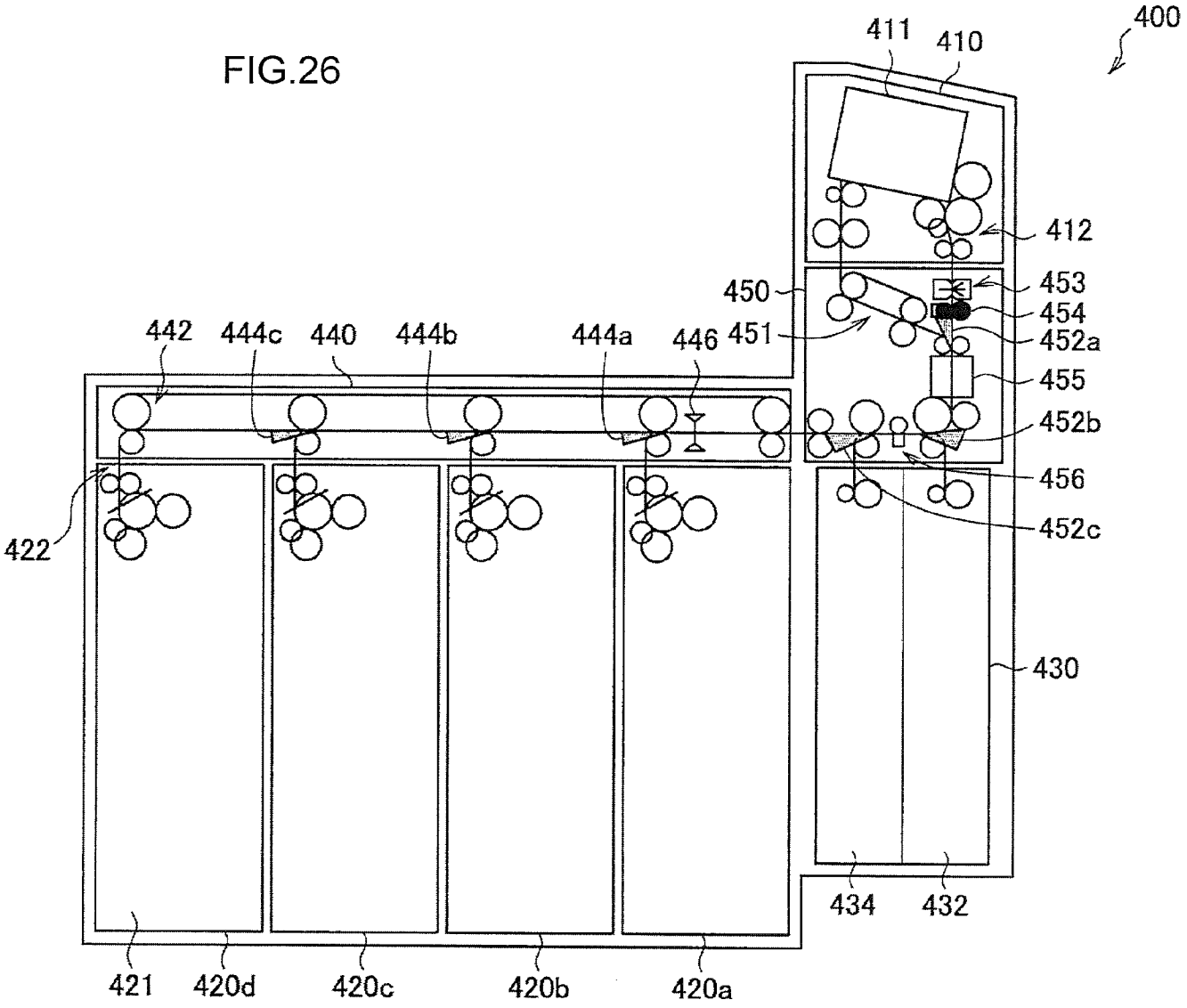
FIG. 26 is a descriptive diagram illustrating another example of the banknote deposit and withdrawal device.

Next, a banknote deposit and withdrawal device 400 that is illustrated in FIG. 26 differs from the banknote deposit and withdrawal device 300 illustrated in FIG. 25 in that the functions of the service unit are divided in two. As illustrated in FIG. 26, the banknote deposit and withdrawal device 400 is constituted with a service unit 410, storage cassettes 420 (420*a* to 420*d*), a reject holding unit 430, a first conveyance unit 440 and a second conveyance unit 450. The storage cassettes 420, the reject holding unit 430 and the first conveyance unit 440 have the same configurations and functions as the storage cassettes 320, the reject holding unit 330 and the conveyance unit 340, so are not described here.

The service unit 410 and the second conveyance unit 450 correspond to the service unit 310 illustrated in FIG. 25. The service unit 310 is a large unit. Therefore, in the banknote deposit and withdrawal device 400 of FIG. 26, the service unit 310 is divided into two units in order to improve ease of maintenance operations when the various sensors or the like have a fault and there is an operation by maintenance staff to replace the unit. Thus, when operations on an individual unit are carried out, such as operations to adjust the various sensors, because the individual units that are used for the adjustments are smaller, ease of adjustment operations may be improved.

Specifically, the service unit 410 is a unit that transfers banknotes to and from a user. The service unit 410 is provided with a service aperture 411 and a conveyance path 412. The service aperture 411 includes a feeding mechanism that feeds out deposited banknotes and a stacking mechanism that stacks withdrawn banknotes. The conveyance path 412 connects the service aperture 411 with the second conveyance unit 450. The second conveyance unit 450 is provided with a conveyance path 451 that conveys banknotes. On the path of the conveyance path 451, switching mechanisms 452*a*, 452*b* and 452*c*, a transmission-type image sensor 453, a thickness sensor 454, a reflection-type image sensor 455 and a magnetic sensor 456 are provided. The sensors are for identifying denominations of banknotes, whether the banknotes are genuine or counterfeit, thicknesses and so forth. Here, for the transmission of driving force to stacking rollers of the service aperture 411 of the service unit 410, a joint mechanism (not illustrated in the drawings) is added at a region at which the conveyance path connecting to the banknote feed-in aperture of the service aperture 411 is divided between the service unit 410 and the second conveyance unit 450.

3-4. Example 4

Figure 27:
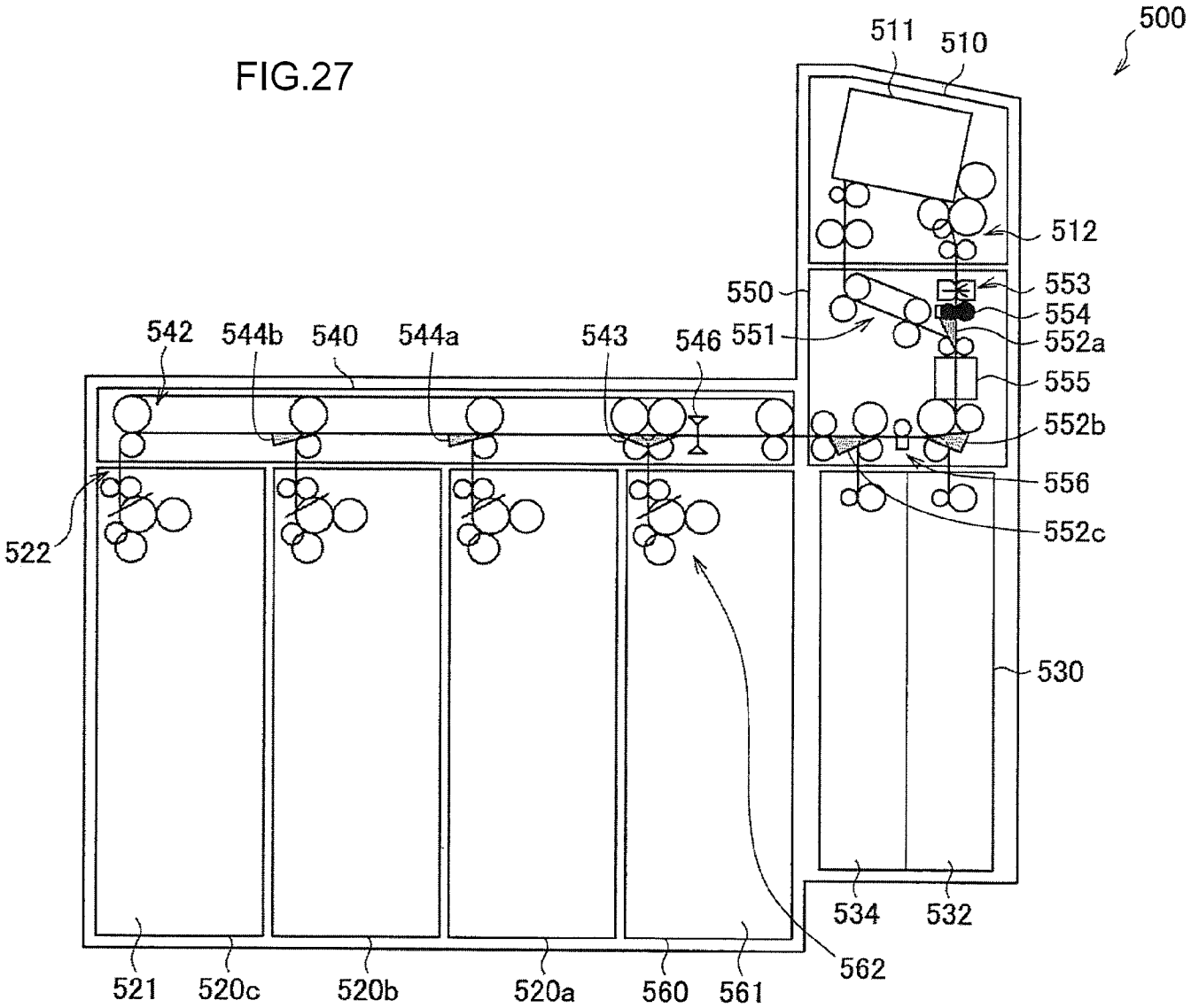
FIG. 27 is a descriptive diagram illustrating another example of the banknote deposit and withdrawal device.

A banknote deposit and withdrawal device 500 that is illustrated in FIG. 27 differs from the banknote deposit and withdrawal devices 100, 200, 300 and 400 described above in that a remaining banknote storage vault 560 is provided, and at least one switching mechanism in the storage cassettes or conveyance unit is capable of switching travel of the banknotes between three directions. Hereinbelow, configurations and functions that are the same as in the banknote deposit and withdrawal device 400 illustrated in FIG. 26 are only briefly described, with differences from the banknote deposit and withdrawal device 400 being more prominently described.

As illustrated in FIG. 27, the banknote deposit and withdrawal device 500 is constituted with a service unit 510, storage cassettes 520 (520*a* to 520*c*), a reject holding unit 530, a first conveyance unit 540, a second conveyance unit 550 and the remaining banknote storage vault 560. The service unit 510, the reject holding unit 530 and the second conveyance unit 550 have the same configurations and functions as the service unit 410, the reject holding unit 430 and the second conveyance unit 450, so are not described here. Although the storage cassettes 520 are fewer in number than the storage cassettes 420 in FIG. 26, the constitutions of the storage cassettes 520*a* to 520*c* have the same configurations and functions as the storage cassettes 420*a* to 420*d*, so are not described here.

The banknote deposit and withdrawal device 500 is equipped with the remaining banknote storage vault 560 in order to simplify processing for separating banknotes to be returned to a customer from banknotes from within the device, which are not to be returned to the customer, when a customer has a problem such as a jam or the like during a transaction and maintenance staff must remove banknotes remaining in the device. As illustrated in FIG. 27, the remaining banknote storage vault 560 may have a similar configuration to the storage cassettes 420, being provided with a storage section 561 and a conveyance path 562. The remaining banknote storage vault 560 is arrayed in the horizontal direction together with the storage cassettes 520, and is disposed at the side closest to the service unit 510. Therefore, the remaining banknote storage vault 560 may easily be caused to function as a storage vault that temporarily stores banknotes.

Because the remaining banknote storage vault 560 is provided, among the switching mechanisms of the first conveyance unit 540, only a switching mechanism 543 that conveys banknotes to the remaining banknote storage vault 560 is formed as a three-way switching mechanism, to be capable of transferring banknotes in three directions, to the second conveyance unit 550, the remaining banknote storage vault 560 and the storage cassettes 520. It is sufficient that other switching mechanisms 544*a* and 544*b* be capable of switching in at least two directions. Other configurations of the first conveyance unit 540 are the same as the configurations of the first conveyance unit 440 illustrated in FIG. 26.

In the banknote deposit and withdrawal devices 200, 300, 400 and 500 with the configurations illustrated in FIG. 24 to FIG. 27, the banknote return processes illustrated in FIG. 3, FIG. 4 and FIG. 14 may be realized by the functions illustrated in FIG. 1 being provided, similarly to the banknote deposit and withdrawal device 100 illustrated in FIG. 5 and the like.

Hereabove, preferred exemplary embodiments of the present invention have been described in detail while referring to the attached drawings, but the present invention is not limited to these examples. It will be clear to the practitioner having ordinary skill in the field of technology to which the present invention belongs that numerous modifications and improvements may be applied within the scope of the technical concepts recited in the attached claims, and that such modifications and improvements are to be understood as being encompassed by the technical scope of the present invention.

For example, in the exemplary embodiments described above, modes are described in which the banknote return processing is applied to a banknote deposit and withdrawal device. However, the present invention is not limited to this example and is also applicable to, for example, a service device (teller machine) of a bank.

Further, in the exemplary embodiments described above, the media that are handled are banknotes, but the present invention is not limited by this example. For example, the banknote deposit and withdrawal devices according to the exemplary embodiments described above may be used for media in the form of pieces of paper, and are applicable to media other than banknotes that hold information like the serial numbers of banknotes with which individual items can be identified, such as, for example, bond certificates, securities and the like.

What is claimed is:

1. A banknote deposit and withdrawal device comprising:

a verification section that verifies banknotes inserted through a service aperture for performing a transaction of banknotes with a user;

a serial number acquisition section that acquires serial numbers of the banknotes;

a control section that controls conveyance of the banknotes in the device; and a memory section that, for each of one or a plurality of a storage cassette in which the banknotes are stored in the device, memorizes the serial numbers of banknotes stored in the storage cassette and memorizes a storage sequence of the banknotes as administration information;

wherein the control section conveys a banknote to a corresponding storage cassette, on the basis of a result of verification, and records the serial number of the banknote and the storage sequence of the banknote in the storage cassette in the memory section as administration information;

wherein the control section detects, with the verification section, whether there is a defect in conveyance of the banknotes, in a case in which banknotes that have been inserted through the service aperture in a current transaction that have been stored in the storage cassette are conveyed to the service aperture in accordance with a request for return of the banknotes of the current transaction;

wherein the control section acquires, one at a time, the serial numbers of the banknotes conveyed from the storage cassette to the service aperture and, in accordance with the administration information, conveys only the banknotes of the current transaction to the service aperture, in a case in which a defect in conveyance of the banknotes is detected by the verification section;

wherein in a case in which the control section detects that banknotes have been brought out together, when banknotes of the current transaction that have been stored in the storage cassette are conveyed to the service aperture in accordance with a request for return of the banknotes of the current transaction; and wherein the control section acquires the serial numbers of the banknotes by conveying the banknotes from the service aperture one at a time, determines if the banknotes are the banknotes of the current transaction based on the acquired serial numbers, and conveys the banknotes that have been determined as being the banknotes of the current transaction back to the service aperture and conveys the banknotes that have been determined as not being banknotes of the current transaction to the storage cassette, based on the determination.

2. The banknote deposit and withdrawal device according to claim 1, further comprising a reporting section that reports information to a user, wherein, when a defect occurs in the banknote deposit and withdrawal device, the control section conveys only the banknotes of a current transaction to the service aperture, in a case in which re-verification of banknotes is possible after the defect occurrence, and the control section reports serial numbers and storage sequences of the banknotes of the current transaction to a user via the reporting section, in a case in which re-verification of the banknotes after the defect occurrence is not possible.

3. The banknote deposit and withdrawal device according to claim 1, wherein the banknote deposit and withdrawal device includes:

a service unit including the service aperture, a conveyance path that connects the service aperture with storage destinations of the banknotes, a switching mechanism that switches a path of travel of the banknotes in accordance with the storage destination of a banknote being conveyed along the conveyance path, and the verification section that verifies the banknote being conveyed along the conveyance path;

one or a plurality of the storage cassette, each including a storage section that stores banknotes, a first conveyance path that connects with the service unit and other adjacent unit, a second conveyance path that conveys banknotes two ways between the first conveyance path and the storage section, a switching mechanism that switches the path of travel of the banknotes, and a thickness sensor that identifies thicknesses of banknotes being fed out from the storage section; and a reject holding unit that stores banknotes that are not retained in the service unit or the storage cassette.

4. The banknote deposit and withdrawal device according to claim 1, wherein the banknote deposit and withdrawal device includes:

a service unit including the service aperture, a conveyance path that connects the service aperture with storage destinations of the banknotes, a switching mechanism that switches a path of travel of the banknotes in accordance with the storage destination of a banknote being conveyed along the conveyance path, the verification section that verifies the banknote being conveyed along the conveyance path, and a thickness sensor that identifies thicknesses of banknotes being fed out to the service aperture;

one or a plurality of the storage cassette, each including a storage section that stores banknotes, a first conveyance path that connects with the service unit and other adjacent unit, a second conveyance path that conveys banknotes two ways between the first conveyance path and the storage section, and a switching mechanism that switches the path of travel of the banknotes; and a reject holding unit that stores banknotes that are not retained in the service unit or the storage cassette.

5. The banknote deposit and withdrawal device according to claim 1, wherein the banknote deposit and withdrawal device includes:

a service unit including the service aperture, a conveyance path that connects the service aperture with storage destinations of the banknotes, a switching mechanism that switches a path of travel of the banknotes in accordance with the storage destination of a banknote being conveyed along the conveyance path, and the verification section that verifies the banknote being conveyed along the conveyance path;

one or a plurality of the storage cassette, each including a storage section that stores banknotes, and a conveyance path that conveys the banknotes two ways to and from the storage section;

a conveyance unit including a conveyance path that connects between the service unit and each storage cassette, one or a plurality of a switching mechanism that switches the path of travel of the banknotes in accordance with the storage destination of the banknote being conveyed along the conveyance path, and a thickness sensor that identifies thicknesses of banknotes fed out from each storage cassette; and a reject holding unit that stores banknotes that are not retained in the service unit or the storage cassette.

6. The banknote deposit and withdrawal device according to claim 1, wherein the banknote deposit and withdrawal device includes:

a service unit including the service aperture, and a conveyance path that connects an adjacent unit with the service aperture;

a verification and conveyance unit including a conveyance path that connects the service unit with storage destinations of the banknotes, a switching mechanism that switches a path of travel of the banknotes in accordance with the storage destination of a banknote being conveyed along the conveyance path, and the verification section that verifies the banknotes being conveyed along the conveyance path;

one or a plurality of the storage cassette, each including a storage section that stores banknotes, and a conveyance path that conveys the banknotes two ways to and from the storage section;

a conveyance unit including a conveyance path that connects between the verification and conveyance unit and each storage cassette, one or a plurality of a switching mechanism that switches the path of travel of the banknotes in accordance with the storage destination of the banknote being conveyed along the conveyance path, and a thickness sensor that identifies thicknesses of banknotes fed out from each storage cassette; and a reject holding unit that stores banknotes that are not retained in the service unit or the storage cassette.

7. A banknote deposit and withdrawal device comprising:

a verification section that verifies banknotes inserted through a service aperture for performing a transaction of banknotes with a user;

a serial number acquisition section that acquires serial numbers of the banknotes;

a control section that controls conveyance of the banknotes in the device; and a memory section that, for each of one or a plurality of a storage cassette in which the banknotes are stored in the device, memorizes the serial numbers of banknotes stored in the storage cassette and memorizes a storage sequence of the banknotes as administration information;

wherein the control section conveys a banknote to a corresponding storage cassette, on the basis of a result of verification, and records the serial number of the banknote and the storage sequence of the banknote in the storage cassette in the memory section as administration information;

wherein the control section detects, with the verification section, whether there is a defect in conveyance of the banknotes, in a case in which banknotes of a current transaction that have been stored in the storage cassette are conveyed to the service aperture in accordance with a request for return of the banknotes of the current transaction;

wherein the control section temporarily stores in the storage cassette, out of the banknotes conveyed from the storage cassette to the service aperture, the banknotes of the current transaction other than a banknote that was stored in the storage cassette first, in a case in which a defect in conveyance of the banknotes is detected by the verification section;

wherein the control section acquires, one at a time, the serial numbers of banknotes remaining in the service aperture and, in accordance with the administration information, alters a storage sequence of the banknotes remaining in the service aperture such that a banknote other than the banknotes of the current transaction is disposed at a banknote feed-out aperture side of the service aperture; and wherein the control section conveys the banknotes of the current transaction that have been temporarily stored in the storage cassette back to the service aperture, and then conveys the banknote other than the banknotes of the current transaction that is disposed at the feed-out aperture side of the service aperture to the storage cassette.

8. The banknote deposit and withdrawal device according to claim 7, further comprising a reporting section that reports information to a user, wherein, when a defect occurs in the banknote deposit and withdrawal device, the control section conveys only the banknotes of a current transaction to the service aperture, in a case in which re-verification of banknotes is possible after the defect occurrence, and the control section reports serial numbers and storage sequences of the banknotes of the current transaction to a user via the reporting section, in a case in which re-verification of the banknotes after the defect occurrence is not possible.

9. The banknote deposit and withdrawal device according to claim 7, wherein the banknote deposit and withdrawal device includes:

a service unit including the service aperture, a conveyance path that connects the service aperture with storage destinations of the banknotes, a switching mechanism that switches a path of travel of the banknotes in accordance with the storage destination of a banknote being conveyed along the conveyance path, and the verification section that verifies the banknote being conveyed along the conveyance path;

one or a plurality of the storage cassette, each including a storage section that stores banknotes, a first conveyance path that connects with the service unit and other adjacent unit, a second conveyance path that conveys banknotes two ways between the first conveyance path and the storage section, a switching mechanism that switches the path of travel of the banknotes, and a thickness sensor that identifies thicknesses of banknotes being fed out from the storage section; and a reject holding unit that stores banknotes that are not retained in the service unit or the storage cassette.

10. The banknote deposit and withdrawal device according to claim 7, wherein the banknote deposit and withdrawal device includes:

a service unit including the service aperture, a conveyance path that connects the service aperture with storage destinations of the banknotes, a switching mechanism that switches a path of travel of the banknotes in accordance with the storage destination of a banknote being conveyed along the conveyance path, the verification section that verifies the banknote being conveyed along the conveyance path, and a thickness sensor that identifies thicknesses of banknotes being fed out to the service aperture;

one or a plurality of the storage cassette, each including a storage section that stores banknotes, a first conveyance path that connects with the service unit and other adjacent unit, a second conveyance path that conveys banknotes two ways between the first conveyance path and the storage section, and a switching mechanism that switches the path of travel of the banknotes; and a reject holding unit that stores banknotes that are not retained in the service unit or the storage cassette.

11. The banknote deposit and withdrawal device according to claim 7, wherein the banknote deposit and withdrawal device includes:

a service unit including the service aperture, a conveyance path that connects the service aperture with storage destinations of the banknotes, a switching mechanism that switches a path of travel of the banknotes in accordance with the storage destination of a banknote being conveyed along the conveyance path, and the verification section that verifies the banknote being conveyed along the conveyance path;

one or a plurality of the storage cassette, each including a storage section that stores banknotes, and a conveyance path that conveys the banknotes two ways to and from the storage section;

a conveyance unit including a conveyance path that connects between the service unit and each storage cassette, one or a plurality of a switching mechanism that switches the path of travel of the banknotes in accordance with the storage destination of the banknote being conveyed along the conveyance path, and a thickness sensor that identifies thicknesses of banknotes fed out from each storage cassette; and a reject holding unit that stores banknotes that are not retained in the service unit or the storage cassette.

12. The banknote deposit and withdrawal device according to claim 7, wherein the banknote deposit and withdrawal device includes:

a service unit including the service aperture, and a conveyance path that connects an adjacent unit with the service aperture;

a verification and conveyance unit including a conveyance path that connects the service unit with storage destinations of the banknotes, a switching mechanism that switches a path of travel of the banknotes in accordance with the storage destination of a banknote being conveyed along the conveyance path, and the verification section that verifies the banknotes being conveyed along the conveyance path;

one or a plurality of the storage cassette, each including a storage section that stores banknotes, and a conveyance path that conveys the banknotes two ways to and from the storage section;

a conveyance unit including a conveyance path that connects between the verification and conveyance unit and each storage cassette, one or a plurality of a switching mechanism that switches the path of travel of the banknotes in accordance with the storage destination of the banknote being conveyed along the conveyance path, and a thickness sensor that identifies thicknesses of banknotes fed out from each storage cassette; and a reject holding unit that stores banknotes that are not retained in the service unit or the storage cassette.

* * * * *